US005982334A

United States Patent [19]

Manasson et al.

[11] Patent Number: 5,982,334

[45] Date of Patent: Nov. 9, 1999

[54] ANTENNA WITH PLASMA-GRATING

[75] Inventors: Vladimir A. Manasson, Los Angeles; Lev S. Sadovnik, Irvine; Vladimir Yepishin, Rancho Palos Verdes, all of Calif.

[73] Assignee: WaveBand Corporation, Torrance, Calif.

[21] Appl. No.: 08/962,176

[22] Filed: Oct. 31, 1997

[51] Int. Cl.[6] ..... H01Q 13/00

[52] U.S. Cl. ..... 343/785; 343/700 MS

[58] Field of Search ..... 343/785, 772, 343/776, 700 MS, 853; 385/15, 3, 5; 342/368; H01Q 13/00

[56] References Cited

U.S. PATENT DOCUMENTS

| | | | |
|---|---|---|---|
| 4,840,485 | 6/1989 | Gratton | 356/317 |
| 4,855,930 | 8/1989 | Chao et al. | 364/497 |
| 5,151,869 | 9/1992 | Alcala | 364/497 |
| 5,196,709 | 3/1993 | Berndt et al. | 250/458.1 |
| 5,212,386 | 5/1993 | Gratton et al. | 250/458.1 |
| 5,257,202 | 10/1993 | Feddersen et al. | 364/498 |
| 5,281,825 | 1/1994 | Berndt et al. | 250/458.1 |
| 5,317,162 | 5/1994 | Pinsky et al. | 250/461.2 |
| 5,323,010 | 6/1994 | Gratton et al. | 250/458.1 |

*Primary Examiner*—Hoanganh Le
*Attorney, Agent, or Firm*—Nilles & Nilles, S.C.

[57] ABSTRACT

Systems and methods for scanning antennas with plasma gratings are described. An apparatus includes a semiconductor slab and an electrode set or illuminating system to inject a plasma grating. The systems and methods provide advantages in the compactness and higher efficiency in comparison with existing antennas.

48 Claims, 19 Drawing Sheets

UPPER ELECTRODE # 1 2 3 4 5 6 7 8 9 . . . . .
APPLIED VOLTAGE E 0 0 E 0 0 E 0 0 . . . . .

ANTENNA WITH PLASMA-GRATING

BACKGROUND OF THE INVENTION

1. Field of the Invention

The present invention relates generally to the field of antennas. More particularly, the present invention relates to scanning antennas that operate based on diffraction of an electromagnetic signal by a modulated non-equilibrium plasma grating. Specifically, a preferred implementation of the present invention relates to a millimeter wavelength (MMW) scanning antenna that operates based on diffraction of a primary beam by a modulated current-injected non-equilibrium plasma grating.

2. Discussion of the Related Art

Historically, the phased array antenna approach (quasi-optical approach) has generally been considered to be the most promising candidate for electronically controlled scanning antennas. The key components of a phased array antenna are the tunable phase-shifters (i.e., true time delay elements). However, these components are costly and often bulky.

In the past, an optical control has been used to improve the performance of phased array antennas. In this approach, infrared or visible light is used to control the electronic devices (e.g. phase-shifters) in the phased array. However, this photonics approach requires expensive photo-electronic (photonic) elements for conversion of the control signals being routed to each of the electronic devices in the array. The large number of photonic elements required for even a modest size array makes the resulting system unaffordable for most applications. This is particularly true for high frequencies (i.e., millimeter wavelength) where the manufacture of the electronic phase shifters themselves is still a challenging problem from a device fabrication perspective.

Nevertheless, the use of fiber optics technology to control an electronically scanned antenna provides a number of advantages in antenna performance. These advantages include: low interference, remote control operation, light weight, low power consumption, and high flexibility.

More recently, an optical approach rather than quasi-optical (phased array) approach was used to design photonically controlled antennas. In the optical approach, no discrete elements, phase-shifters, photo-detectors, etc., are needed. Instead of directing a millimeter wavelength beam through a photonically controlled array of discrete electronic elements, a reconfigurable plasma-grating is used to steer the antenna beam. A photo-induced plasma is excited in a semiconductor medium so as to form a periodic structure that functions as the diffraction grating. This direct approach eliminates the need for conventional phase-shifters and is a promising solution to the need to provide inexpensive beam steering in the millimeter wavelength band. The direct approach holds particular promise for such price sensitive applications as automobile collision warning systems.

Thus, a wholly optical approach, rather than quasi-optical, has been developed where a semiconductor slab containing a non-equilibrium electron-hole plasma is used as a holographic medium for diffraction of millimeter waves, thereby steering the antenna beam. Plasma patterning within the semiconductor slab defines the diffraction grating and allows the shaping of a passing millimeter wavelength beam so as to send it in a required direction. The main advantage of this direct approach is the avoidance of any need for tunable phase-shifters or other true time delay elements, thereby providing a dramatic cost reduction.

Referring to FIGS. 1A–1B, an antenna design utilizing this direct approach has been fabricated and tested in the past. Referring to FIG. 1A, a millimeter wavelength signal 10 propagates along a semiconductor waveguide 20. Alternatively, the propagation can be through a compound dielectric waveguide containing a photosensitive layer. By patterned illumination, a photo-induced plasma grating 30 (PIPG) is excited in the semiconductor waveguide 20, near its surface. The plasma grating 30 has a grating period $\Lambda$. As in a leaky-wave antenna loaded with a metal grating, the millimeter wavelength signal 10 propagating along the semiconductor waveguide 20 interacts with the plasma grating 30 and couples out in a specific direction (i.e., at an angle $\phi$) that is a function of the grating period $\Lambda$.

Referring now to FIG. 1B, the main disadvantage of this previous design is that the plasma grating 30 also significantly attenuates the millimeter wavelength signal 10 and prevents the millimeter wavelength signal 10 from propagating effectively along the entire length of the semiconductor waveguide 20. The amplitude of the transmitted millimeter wavelength signal (represented in FIG. 1B by the three parallel arrows of diminishing length) decreases as a function of the length of waveguide 20 through which the millimeter wavelength signal 10 has passed before being diffracted by grating 30. Therefore, it is very difficult to produce a radiating aperture of reasonable size with this design.

SUMMARY AND OBJECTS OF THE INVENTION

Thus, there is a particular need for plasma grating antennas wherein the attenuation of the propagating signal is minimized and/or accommodated so as to increase the radiating aperture, thereby improving performance. Some embodiments of the present invention address this need with a plasma grating with sophisticated waveguide and feeder configurations. New antenna architecture allows the use of not only photonically generated plasma grating, but also an electrode system and a plasma-grating generated by current injection. Unexpected beneficial effects of current injected plasma gratings, which are substantial improvements over the prior art, include a much deeper plasma that is not surface segregated and the ability to extract previously generated plasma by reverse bias, and driving some electrodes at a lower current so as to permit suppression of side lobes.

These, and other, aspects and objects of the present invention will be better appreciated and understood when considered in conjunction with the following description and the accompanying drawings. It should be understood, however, that the following description, while indicating preferred embodiments of the present invention and numerous specific details thereof, is given by way of illustration and not of limitation. Many changes and modifications may be made within the scope of the present invention without departing from the spirit thereof, and the invention includes all such modifications.

BRIEF DESCRIPTION OF THE DRAWINGS

A clear conception of the advantages and features constituting the present invention, and of the construction and operation of typical mechanisms provided with the present invention, will become more readily apparent by referring to the exemplary, and therefore nonlimiting, embodiments illustrated in the drawings accompanying and forming a part of this specification, wherein like reference numerals designate the same elements in the several views. It should be noted that the features illustrated in the drawings are not necessarily drawn to scale.

DESCRIPTION OF PREFERRED EMBODIMENTS

The present invention and the various features and advantageous details thereof are explained more fully with reference to the nonlimiting embodiments that are illustrated in the accompanying drawings and detailed in the following description. Descriptions of well known components and processing techniques are omitted so as to not unnecessarily obscure the present invention in detail.

Figure 1A:
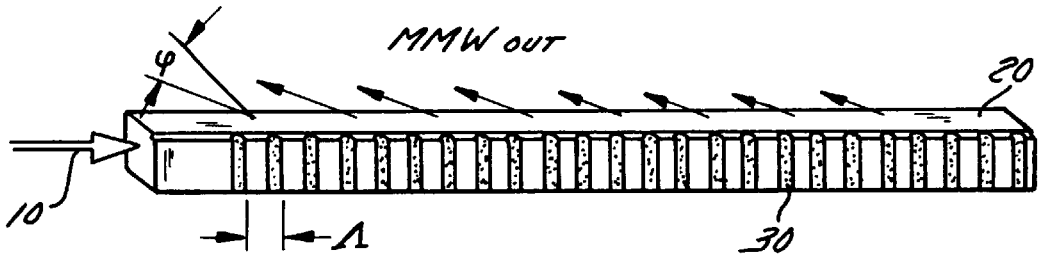
FIG. 1A PRIOR ART
FIGS. 1A–1B illustrate schematic perspective views of a conventional photo induced plasma grating based antenna element, appropriately labeled "PRIOR ART"
Figure 1B:
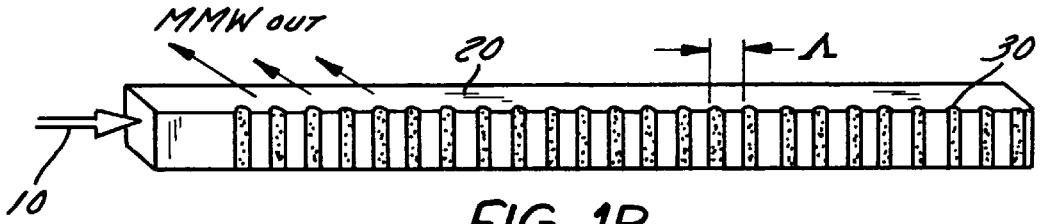
FIG. 1B PRIOR ART
Figure 2:
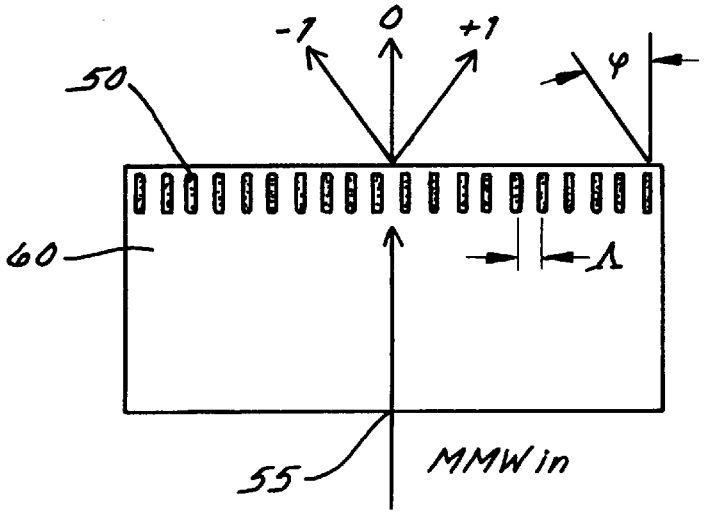
FIG. 2 illustrates a schematic sectional view of a semiconductor slab wherein a normally incident MMW beam is being diffracted by a plasma grating, representing an embodiment of the present invention.

Referring to FIG. 2, plasma within a semiconductor slab 60 creates a periodic structure 50 with a period $\Lambda$. The periodic structure 50 is a plasma grating which will function as a diffraction grating for millimeter waves propagating through the semiconductor slab 60. If a primary millimeter wavelength beam 55 is incident onto the grating perpendicular to the grating plane, as shown in FIG. 2, then, in general, there will be three output beams: "0"-order, "+1"-order, and "−1"-order. The directions of the "+1" and "−1" order beams depend on the period $\Lambda$ and can be controlled by changing the diffraction grating pattern. The "+1" and "−1" order beams each define an angle $\phi$ to the normal "0" order beam. However, for most applications an antenna needs to radiate only one steered beam.

The plasma grating can be generated in a number of ways. Two preferred ways to generate the plasma grating are by current-injection and by photon-injection. In either case, the basic concept is the same and the basic process steps are similar.

Figure 3:
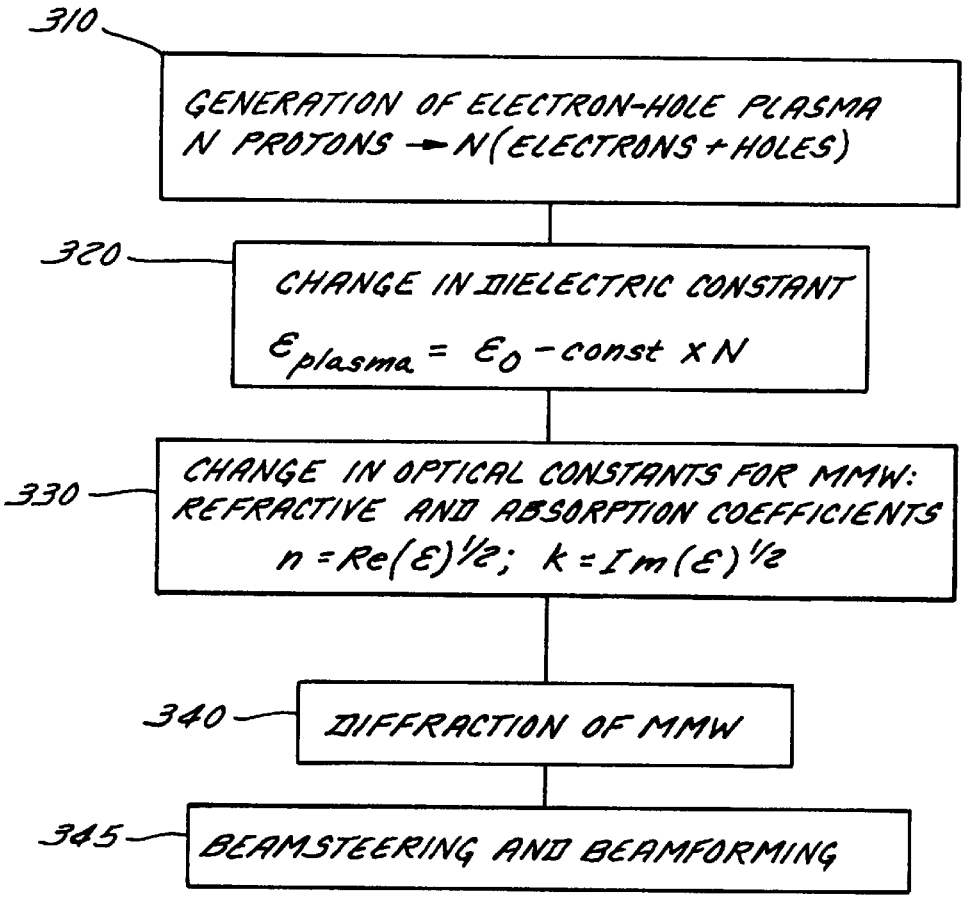
FIG. 3 illustrates a block diagram of a method of beam-steering and beamforming, representing an embodiment of the invention.

Referring to FIG. 3, a generic photon-injection method according to the invention begins with a first step 310 that includes the generation of an electron-hole plasma grating by photon injection. N-photons generate N(electrons+holes) (i.e., the plasma) in a propagation medium. A second step 320 includes a change in dielectric constant in the propagation medium. This change is caused by the plasma. A third step 330 includes a change in optical constants for millimeter wavelength refractive and absorption coefficients within the propagation medium where the plasma exists. A fourth step 340 includes the diffraction of millimeter waves within the propagation medium by the plasma grating. A fifth step 345 includes beam steering and beamforming of the diffracted beam that is effected by changing the grating period of the plasma grating in the propagating medium.

Figure 4:
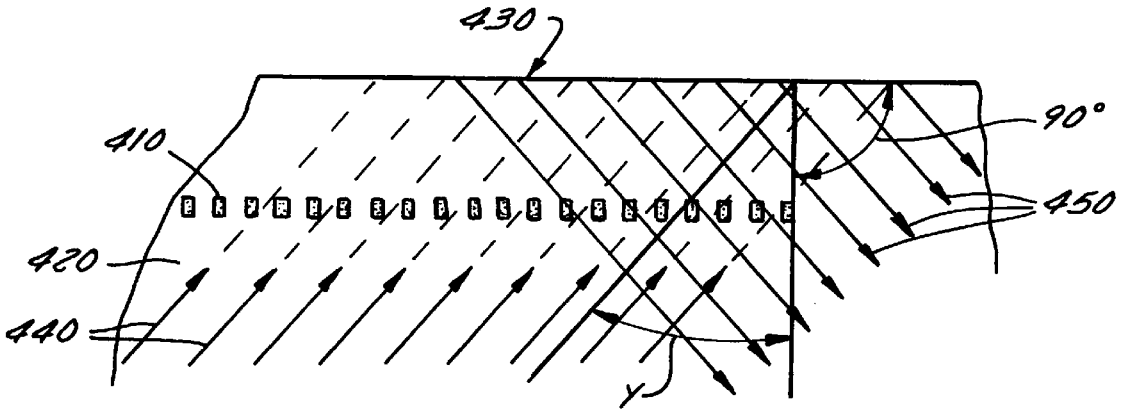
FIG. 4 illustrates a schematic sectional view of zero order diffraction by a generic injected plasma grating in a semiconductor structure, representing an embodiment of the invention.

Referring to FIG. 4, the phenomenon of total internal reflection can be used to filter out from the output the zero order (undiffracted) beam, as well as all positive order diffracted beams. A plasma grating 410 is generated within a semiconductor plate 420. The plasma grating 410 is a spatially periodic structure created with non-equilibrium electron-hole pairs. Semiconductor plate 420 is provided with an output border 430. The output border 430 can be an interface between the semiconductor plate 420 and ambient air. A primary millimeter wavelength beam 440 represented in FIG. 4 by the plurality of parallel solid arrowheads, propagates through the semiconductor plate 420 at a propagation angle $\gamma$. The propagation angle $\gamma$ is defined with respect to a normal to the output border 430. $\gamma>\theta$, where the total internal reflection angle $\theta=\arcsin(k_0/\beta)$, where $k_0$ is the wave number of the propagating waves in free space and $\beta$ is the propagation constant for the waves propagating within the material from which the semiconductor plate 420 is fabricated. For a given total internal reflection angle $\theta$ for the material from which semiconductor plate 420 is fabricated, the "0" order (undiffracted) and all positive order diffracted beams generated from the primary millimeter wavelength beam 440 will be totally internally reflected provided that the propagation angle $\gamma$ is greater than the total internal reflection angle $\theta$. A totally reflected zero order beam 450 is represented in FIG. 4 by the plurality of parallel dashed arrowheads. Due to the fact that $\gamma>\theta$, the zero order (undiffracted) beam is prevented from passing through the output border 430. Similarly, all of the positive order diffracted beams are also totally internally reflected. Conversely, all of the negative order diffracted beams will pass through the border 430. Only the zero order beam is shown in FIG. 4. The semiconductor material from which the semiconductor plate 420 is fabricated can be any semiconductor such as, for example, silicon, germanium, gallium arsenide, indium phosphate, etc.

Figure 5:
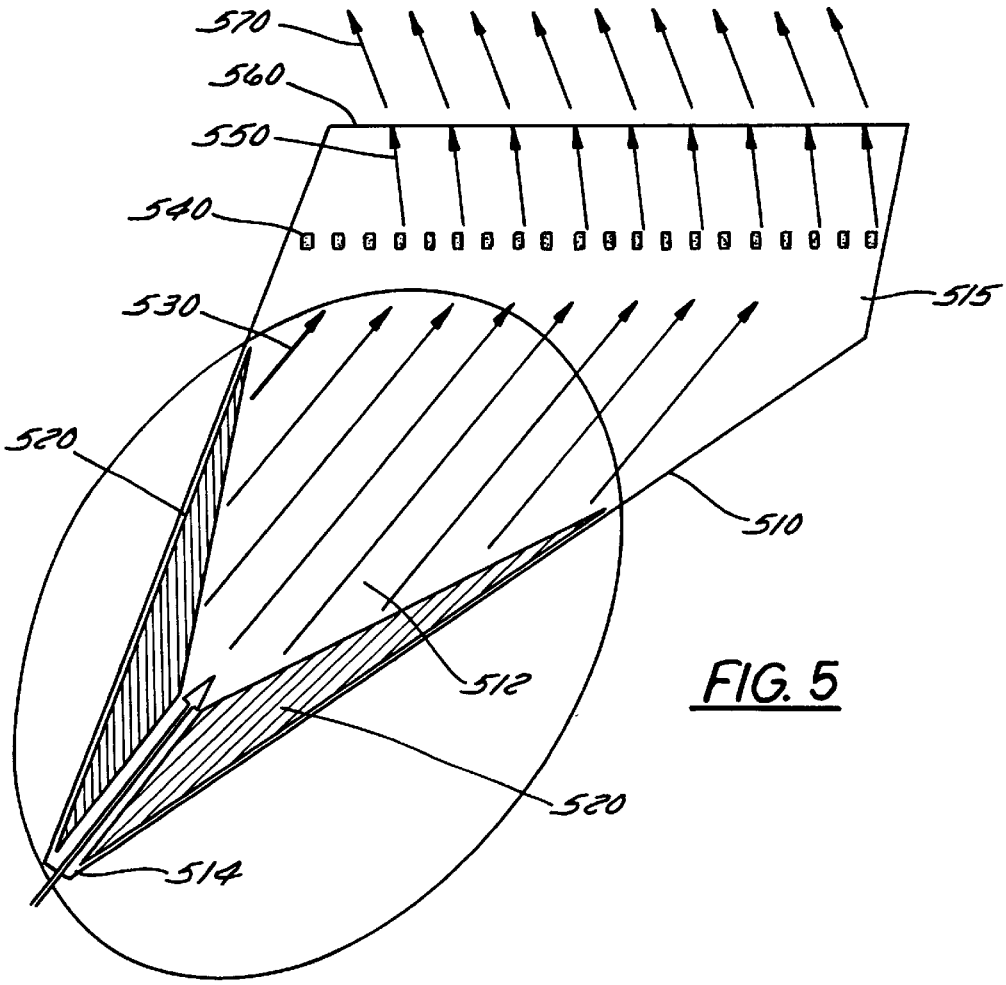
FIG. 5 illustrates a schematic perspective sectional view of 1-order diffraction in a strip line horn feeder semiconductor plate, representing an embodiment of the invention.

Referring now to FIG. 5, a stripline horn feeder 510 can include an integrally formed rectilinear slab 515. The stripline horn feeder 510 is an asymmetric slab prism. The stripline horn feeder 510 includes a signal broadening section 512 and a signal direction section 514. The stripline horn feeder 510 can be provided with layers of copper foil 520 to facilitate the formation of a primary millimeter wavelength beam 530. In FIG. 5, the primary millimeter wavelength beam 530 is represented by the lower tier plurality of parallel arrowheads. The foil 520 can be silver and/or copper or any other suitable conductive material. The foil 520 can be vapor deposited and/or photolithographically patterned. An injected plasma grating 540 causes diffraction of the primary millimeter wavelength beam 530. In FIG. 5, the −1 order diffracted beam 550 is represented by the middle tier plurality of parallel arrowheads. Upon passing through an interface 560, the "−1" order beam is further deflected from the normal to the interface 560 by refraction resulting in an output beam 570 that is represented in FIG. 5 by the top tier plurality of parallel arrowheads.

Figure 6:
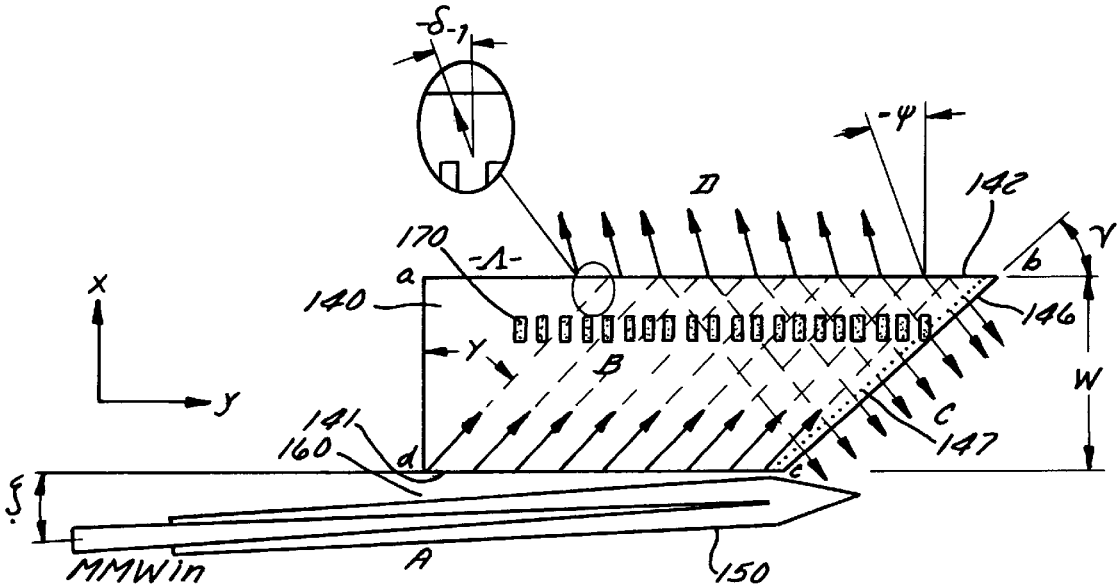
FIG. 6 illustrates a schematic sectional view of rays propagating through a semiconductor plate, representing an embodiment of the invention.

Referring now to FIG. 6, the geometry of the millimeter wavelength rays propagating through a semi-conductor slab 140 can be better appreciated. A dielectric waveguide 150 coupled at its left end to a standard metal waveguide (not shown) and on one of its sides to the semi-conductor slab 140 (which can be made of silicon or other suitable semiconductor material) which serves as a feeder for the antenna module. The dielectric waveguide 150 functions as a feeder for an input beam A. The separation of the dielectric waveguide 150 from the semiconductor slab 140 allows freedom and flexibility in designing the antenna module. A quartz rod can be used as the dielectric waveguide 150. The diameter of such a quartz rod determines the propagation constant of the dielectric waveguide 150, the power carried by the corresponding evanescent wave, and the angles for the resulting coupled and output beams. The angle $\zeta$ between the dielectric waveguide 150 and the semiconductor slab 140 determines a spacing 160 and consequently the power distribution in the coupled beam B. The size of the radiating aperture depends on the width of the beam B and can be controlled by the width of the tunnel gap between the quartz rod 150 and the silicon slab 140. As a feeder, the dielectric waveguide 150 should be located close to the semiconductor slab 140. In more detail, the distance at any given point between the waveguide 150 and the slab 140 determines both the width of the coupled beam and the effective size of the output aperture.

Still referring to FIG. 6, the semiconductor slab 140 includes two parallel faces 141 and 142. Near the upper (output) face 142 a plasma grating 170 is generated. The plasma grating 170 can be generated by current injection or photon injection. The primary millimeter wavelength beam B propagates inside the slab 140 and impinges upon the upper face 142 at an angle $\gamma$ that is larger than the total internal reflection angle. This prevents the "0" order diffraction beam from passing through the slab/air interface and contaminating the output radiation. The propagation constant for the millimeter wavelength signal in the silicon slab 140 is higher than the propagation constant in the waveguide 150. In more detail, a millimeter wavelength signal propagating through the dielectric waveguide (beam A) tunnels into the slab (beam B) and propagates at an angle $\gamma$ determined by the relationship $$\gamma=\arcsin(n_{rod}/n_{slab}) \quad \text{Eq. (1)}$$

where $n_{rod}$, $n_{slab}$ are the effective refractive indexes for millimeter wavelength signals in the rod and in the slab, respectively, with $n_{rod}<n_{slab}$. As noted earlier, the angle $\gamma$ is larger than the total internal reflection (TIR) angle in the slab. The TIR angle is determined by the relationship $$TIR=\arcsin(1/n_{slab}) \quad \text{Eq. (2)}$$

Therefore, the "0" order beam is totally reflected from the upper face, thereby forming a reflected beam (beam C). The angle $\gamma$ is selected so as to allow beam C to leave the slab with minimum reflection. Tapering a facet 146 in the direction perpendicular to the plane of the drawing can contribute to minimizing reflection. Alternatively, an absorption zone 147 can be doped into the slab 140. There is a wide interval of $\Lambda$ magnitudes where the only output beam will be the "−1"-order beam (beam D) generated by the diffraction grating 170. The propagation angle of beam D, $\phi$, does not depend on the effective refraction index in the slab and can be found from the formula:

$$\phi=\arcsin(n_{rod}-\lambda/\Lambda) \quad \text{Eq. (3)}$$

where $\lambda$ is the wavelength of the millimeter wavelength signal in free space, $\Lambda$ is the grating period, and $n_{rod}$ is the refractive index in the rod. From Eq. (3) it can be appreciated that the angle $\phi$can be changed by varying the grating period $\Lambda$.

The propagation constant in the dielectric waveguide 150 is smaller than that in the semiconductor slab 140, (i.e., $\beta_{wg}<\beta_{sl}$). The original Beam A propagates along the dielectric waveguide 150 and tunnels into the semiconductor slab 140 through the narrow tunnel gap 160 between them. The small angle $\zeta$ (e.g., $\zeta<5$ degrees) between the slab lower edge (the lower facet 141 of slab 140 as drawn in FIG. 6) and the waveguide 150 makes the coupled Beam B, more uniform along the y-direction. As with any leaky-wave type antenna, the coupling strength distribution should be designed to fill the entire antenna aperture so as to optimize the beam pattern of the outgoing radiation Beam D. The propagation angle, $\gamma$, inside the slab depends on the relation between the two propagation constants, $\beta_{wg}$ and $\beta_{sl}$ and on the angle $\zeta$ in accordance with the relationship:

$$\gamma=\arcsin[(\beta_{wg}\cos\zeta)/\beta_{sl}] \quad \text{Eq. (4)}$$

If the photo-induced plasma grating 170 is parallel to the lower facet 141 or edge of the slab 140, then the Beam B impinges upon the grating at the same angle $\gamma$. The grating diffraction orders will propagate in directions described by angles, $\delta_p$, defined by the equation:

$$\beta_{sl}\sin\delta_p=\beta_{sl}\sin\gamma+p(2\pi/\Lambda) \quad \text{Eq. (5)}$$

where p= . . . −1,0, +1, +2 . . . is the diffraction order and $\Lambda$ is the grating period. Under the following conditions $$[\beta_{sl}(1+\sin\gamma)]^{-1}<\Lambda/2\pi<\{[\beta_{sl}(1-\sin\gamma)]^{-1}-2[\beta_{sl}(1+\sin\gamma)]^{-1}\} \quad \text{Eq. (6)}$$

there exist only "0" and "−1" diffraction orders (p=0, −1).

When the "0" beam impinges onto the slab upper face 142 or edge of the semiconductor slab 140, (which is parallel to the lower surface as drawn in FIG. 6), it experiences total internal reflection and refraction, respectively. In more detail, if $$\beta_{wg}\cos\zeta>k_0 \quad \text{Eq. (7)}$$

where $k_0=2\pi/\lambda$ is the propagation constant in free space, (and $\lambda$ is the millimeter wave's wavelength in vacuum) then, according to Eq. (4), the angle $\gamma$ is the larger than the total internal reflection angle (TIR), where TIR=$\arcsin(k_0/\beta_{sl})$. The important consequence of this is that the "0" order beam is totally reflected from the slab/air interface and does not contribute to the output beam.

The remaining "−1"-order beam is partially reflected back (not shown in FIG. 6) and partially refracted. The refracted part provides the main contribution to the output beam (Beam D). This beam propagates in a direction corresponding to an angle $\phi$:

$$\phi=\arcsin[\beta_{sl}\sin(\delta_{-1})/k_0] \quad \text{Eq. (8)}$$

or, after substitution from Eqs. (4) and (5)

$$\phi=\arcsin[\beta_{wg}\cos(\zeta)/k_0-\lambda/\Lambda] \quad \text{Eq. (9)}$$

Referring to Eq. (9), it can be appreciated that the angle $\phi$ does not depend on the propagation constant in the semiconductor slab, $\beta_{sl}$. Moreover, if due to the small value of the angle $\zeta$, it is assumed that $\cos(\zeta)\cong1$, then the angle $\phi$ coincides with the angle of radiation from a dielectric rod loaded with a metal grating of the same period $\Lambda$ such that $$\phi\cong\arcsin(\beta_{wg}/k_0-\lambda/\Lambda) \quad \text{Eq. (10)}$$

Referring again to Eq. (9), it can be appreciated that the output beam angle can be controlled by varying the grating period. In the case of photon injection this was accomplished by changing the grating pattern $\Lambda$ via the use of a plurality of photomasks.

The semiconductor slab 140 is the main component of the antenna module. It can be made from a silicon monocrystal that is grown using a float zone technique. This semiconductor material is an excellent medium for plasma-millimeter wave interaction. Silicon is known as the most widely used material in microelectronics. It is cost effective and possesses some unique features amenable to integration.

The thickness W of the slab 140 has a direct impact on the millimeter wavelength propagation constant within the slab, (i.e., on the effective refraction index). The power distributed among the beams of different diffraction orders depends on the angle between the grating and the incident beam that, in turn, depends on the refractive index of the slab. Thus, selection of the slab thickness is an important task. To some extent, an additional degree of freedom to correct the angle between the grating and the incident beam can be provided by varying the slope of the grating. The goal is to raise the diffraction efficiency in the "−1" direction to a level comparable with an ideal Bragg's grating efficiency. To eliminate the destructive interference that the reflected beam C can, after multiple reflections, introduce to the output beam, a slab wide enough to rule out a second reflection from the lower face of the slab can be used. An additional structure to suppress this destructive interference effect is an absorptive area that can be created by inserting into the b-c region a donor or acceptor impurity.

Figure 7:
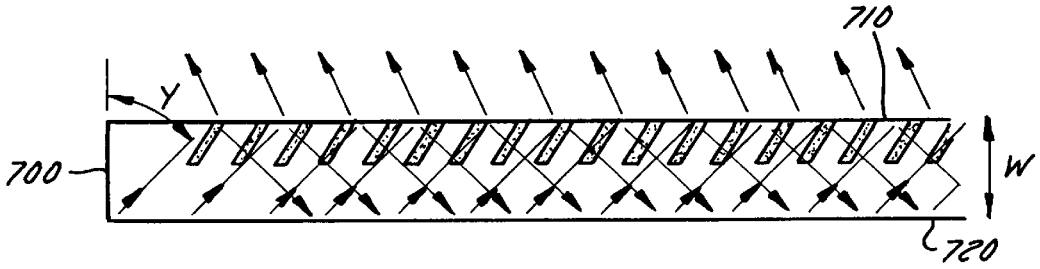
FIG. 7 illustrates a schematic sectional view of resonance within a multireflection plate to produce constructive interference, representing an embodiment of the invention.

Referring now to FIG. 7, a slab 700 having a width W can be optimized for efficient operation. In preferred embodiments, the semiconductor plate thickness (width W) corresponds to a single mode operation. In addition, the slab should be wide enough to keep the plasma grating sufficiently far from the quartz rod (waveguide), so that the propagation of millimeter wavelength signals is not affected. In a supplemental design, the width W can be selected in such a manner that the round-trip pass-length for the TIR beam propagating from the upper face 710 and back-reflected from the lower face 720 comprise exactly a whole multiple of wavelengths, as expressed by the relationship:

$$2W\beta_{sl}/\cos\gamma=2\pi M \quad \text{Eq. (11)}$$

This will result in a constructive interference and additional power in the desired direction. The necessary conditions to obtain constructive interference between the original millimeter wavelength beam and the back-reflected beam created as a result of total internal reflection from both boundaries of the plate are that the semiconductor plate width can be expressed by the relationship $$W=\pi m\cos\gamma/\beta_{sl} \quad \text{Eq. (12)}$$

where m is an integer, $\gamma$ is the propagation angle, and $\beta_{sl}$ is the propagation constant for millimeter wavelength energy within the semiconductor plate. Thus, the power of the totally internal reflected beam will be redirected back toward the desired direction. In this way, the semiconductor plate can be long and narrow.

As already noted, for any given grating period $\Lambda$, the angle $\phi$ of the output beam does not depend on the propagation constant of the planar waveguide, and thus remains the same for both $TE_0$ and $TM_0$ modes. By using both the $TE_0$ and $TM_0$ modes, the output beam can be made a superposition of these polarizations. By properly choosing the phase delay between the two linear polarizations, a circularly polarized output beam can be obtained even though the input millimeter wavelength source is linearly polarized. The required phase delay can be achieved by utilizing the difference i) in propagation constants and ii) in the angles, $\gamma$, for the two orthogonal polarizations.

Figure 9:
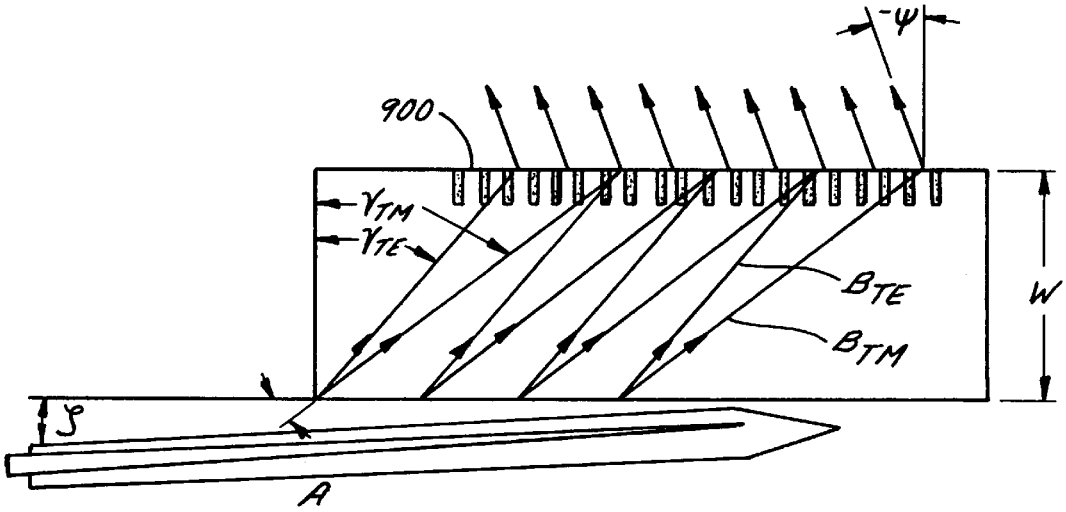
FIG. 9 illustrates a schematic sectional view of two modes (i.e., TE and TM) propagating through a semiconductor slab, representing an embodiment of the invention.

Referring to FIG. 9, the original beam A is linearly polarized in a direction forming an angle, p≅45 degrees, with the plane of the drawing. The input beam A excites two orthogonal modes propagating in the planar slab waveguide. These two modes have distinct propagation constants $\beta_{TE}$ and $\beta_{TM}$ and these propagate at different angles ($\gamma_{TE}$ and $\gamma_{TM}$) in the slab. In general, they arrive at the emitting surface of the slab (antenna aperture) at different times, and therefore in different phases. By proper selection of the slab width, w, the phase difference between the two combined beams on the antenna aperture 900 can be made $\pi/2$. If under these conditions the amplitudes of the $TE_0$ and $TM_0$ propagating modes are equal, then the output beam will be circularly polarized.

Figure 10:
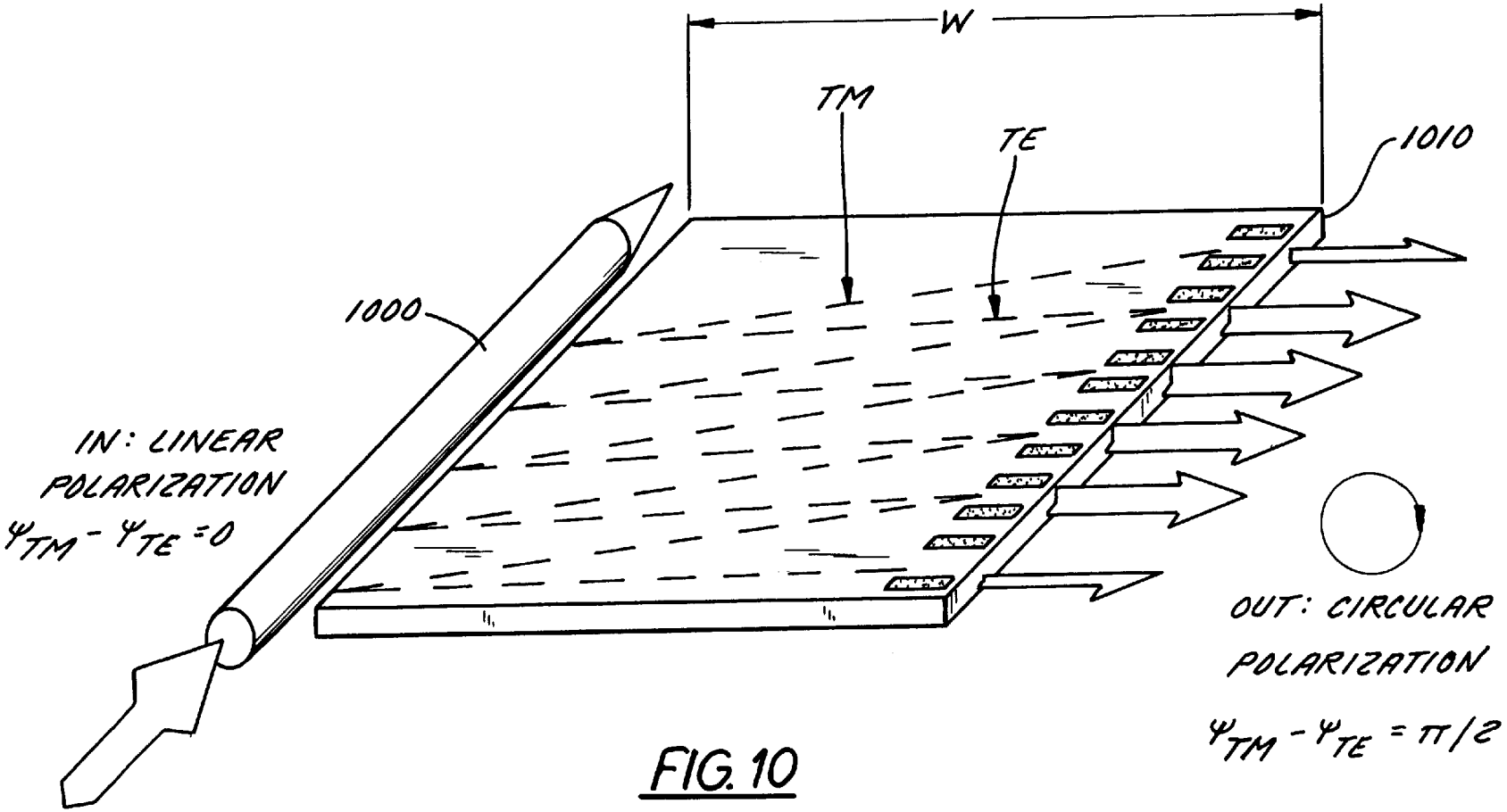
FIG. 10 illustrates a perspective view of an antenna with a circularly polarized output beam, representing an embodiment of the invention.

Referring to FIG. 10, a dielectric waveguide 1000 is arranged proximate to a rectilinear slab 1010. The input signal in the dielectric waveguide 1000 is linearly polarized. The polarization vector of the beam is a superposition of the two basis vectors corresponding to the two orthogonal modes TE and TM. Thus, a decomposition of the circularly polarized vector will yield the orthogonal vectors TM and TE. The different propagation constants for $\beta_{TM}$ and $\beta_{TE}$ ($\beta_{TM} \neq \beta_{TE}$) results in different coupling angles $\gamma_{TM}$ and $\gamma_{TE}$. The silicon plate width W to obtain a circularly polarized output beam is $$W=(\pi/2+\pi m)/(\beta_{TM}/\cos\gamma_{TM}-\beta_{TE}/\cos\gamma_{TE}) \quad \text{Eq. (13)}$$

where m is an integer; $\beta_{TM}$ and $\beta_{TE}$ are propagation constants for TM and TE modes inside the semiconductor slab; and $\gamma_{TM}$ and $\gamma_{TE}$ are coupling angles for the TM and TE polarization. The different propagation constants $\beta_{TM}$ and $\beta_{TE}$ provide different effective lengths of propagation for the different modes. Thus, a circular polarization output is obtained from a linearly polarized input. The conversion is simultaneous and continuous.

Current-Injected Plasma Grating Embodiments

An electron-hole plasma can be excited in a semiconductor not only by photo-injection but also by current-injection through electrodes. The current-injection design provides a further dramatic cost reduction by permitting the use of millimeter integrated circuit (MMIC) technology.

In general, the interaction of a passing millimeter wavelength signal with an electrode system may produce undesirable effects. For example, electrodes forming a grating pattern may generate a parasitic beam. Fortunately, it has been established that some current-injected antenna designs are free of any such effects.

Figure 11:
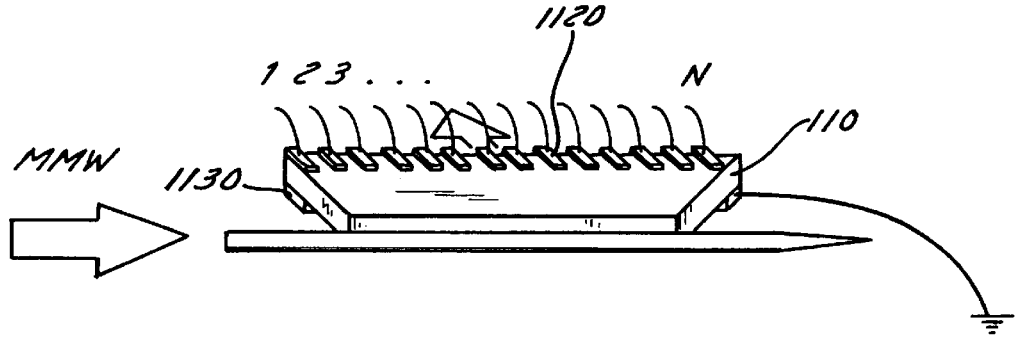
FIG. 11 illustrates a schematic perspective view of a current injection plasma grating antenna, representing an embodiment of the invention.

Referring to FIG. 11, the direct injection of plasma via current inducing electrodes provides for an efficient and compact antenna design. A semiconductor slab 1110 is provided with a plurality of upper electrodes 1120 and a lower electrode 1130. The lower electrode is grounded. The plurality of upper electrodes can for convenience be numbered 1, 2, . . . , as in FIG. 11. In the embodiment depicted in FIG. 11, the upper electrodes 1120 are highly doped N electrodes that provide a reservoir of electrons. As a corollary, the lower electrode 1130 is highly P doped so as to provide a reservoir of holes. In the depicted embodiment, a voltage is applied to upper electrodes 1, 4, and 7. Thus, plasma zones are generated between the corresponding upper and lower electrode sets. As a result, a grating period $\Lambda$ of a dimension equal to 3 electrode spacing units is generated.

The number of scanning positions can be as few as, for example, five. An electrode spacing as wide as a=0.5 mm can be used. Such a configuration will enable five different plasma gratings with periods from 2 to 4 mm. For example, to create a grating with a period of 3 mm and a duty cycle of 50% the electrodes No. 1, 2, 3; 7, 8, 9; . . . 3*i*+1, 3*i*+2, 3*i*+3; . . . can be switched on. At 94 GHz, this electrode geometry is capable of generating five different beams within an angle of about 30 degrees without any additional parasitic beams from the electrode grating.

To inject the electron-hole plasma that defines the diffraction grating a vertical $P^+$-I-$N^+$ structure can be used. $P^+$-I-$N^+$ diodes are widely used in switching at microwave frequencies.

Figure 12:
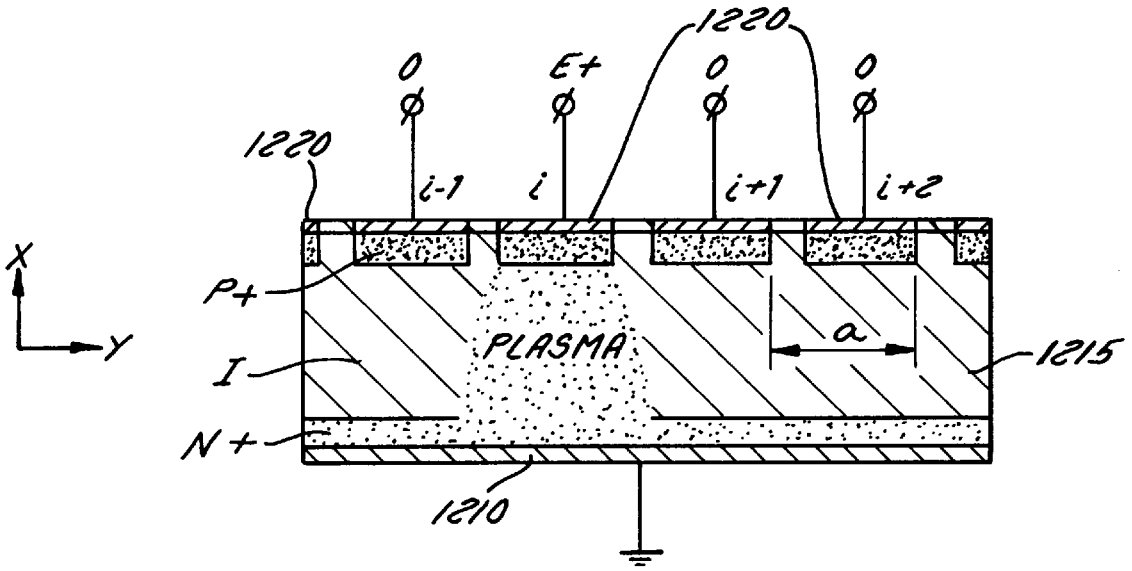
FIG. 12 illustrates a schematic sectional view of a semiconductor slab with current injected plasma grating electrodes, representing an embodiment of the present invention.
Figure 13:
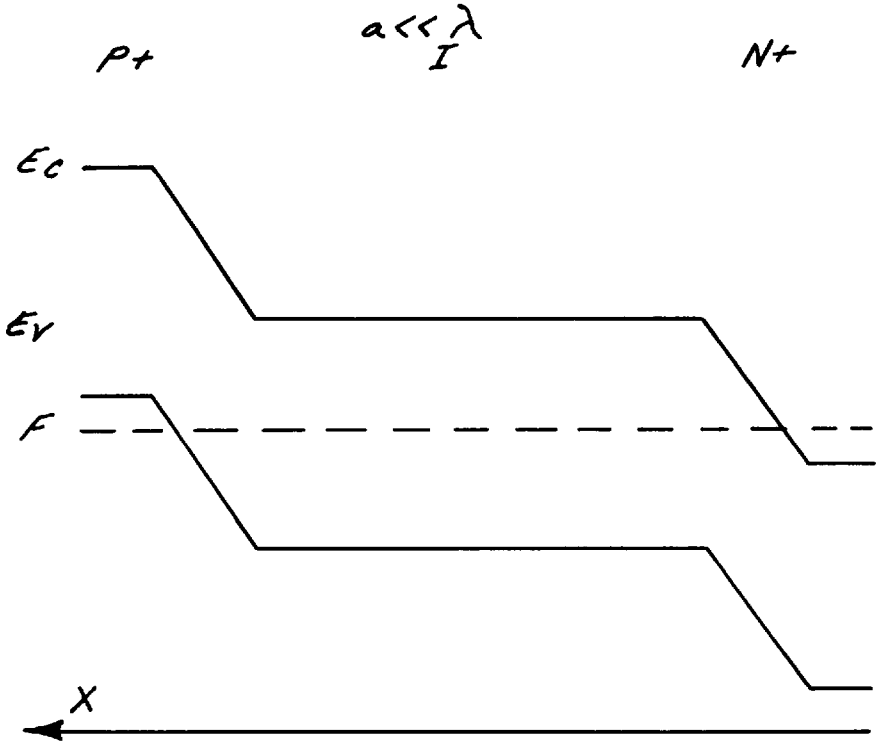
FIG. 13 illustrates an equilibrium zone diagram of the electrode area of the semiconductor slab illustrated in FIG. 12.

An exemplary slab cross section and a corresponding band diagram for such a structure are shown in FIGS. 12 and 13, respectively. Referring to FIG. 12, the lower, positive, electrode 1210 is shared by the whole active area of a silicon slab 1215. The upper, negative, electrodes 1220 represent a periodical array with spacing a. It should be noted that the resulting electrode array can act as an additional non-electrode diffraction grating which interferes with the main plasma grating. But if the spacing a is small, the electrode grating cannot produce an additional beam, although it can increase the side lobes. The smaller the spacing a, the lower the interference from the electrode grating. Small spacings between electrodes are preferable from yet another point of view. To scan the output beam, the electrodes need to be switched, (hence the digital nature of the control). To make control more flexible, the number of switchable electrodes can be increased, thus ensuring smaller scanning steps. The tradeoff is that a large number of electrodes entails a large number of controlling channels, thereby making electronic circuitry more complex.

Under a direct bias, a $P^+$ electrode injects holes and a $N^+$ electrode injects electrons into the intrinsic region of the $P^+$-I-$N^+$ structure. The slab thickness should be smaller than the ambipolar diffusion length. Then both electrons and holes will fill the space between the electrodes with sufficient uniformity, as shown in FIG. 12. Such a plasma distribution differs from the distribution occurring when plasma is generated by illumination (in the latter case the plasma is concentrated at the illuminated surface). A uniformly distributed plasma has a stronger effect on the millimeter waves than a plasma of the same carrier number but concentrated at one of the surfaces of the slab. Another advantage of the $P^+$-I-$N^+$ structure is that injected plasma can be extracted from the slab by reverse bias, which is impossible in the case of photo injection. This extraction process is much faster than plasma recombination, the only mechanism to effect plasma decay in the case of photo injection.

Referring to FIG. 13, the relative doping concentrations for the P and N regions can be appreciated. The Fermi level (F) is represented by the dashed horizontal line. The concentration represented in FIG. 13 corresponds to the structure depicted in FIG. 12. Moving from the left to the right in FIG. 13 corresponds to moving from the top to the bottom in FIG. 12. P plus doping can be obtained by using arsenic or boron. N plus doping can be obtained by using phosphorous or antimony. $E_c$ represents the energy level of the conductive band. $E_v$ represents the energy level of the valence band.

Figure 14:
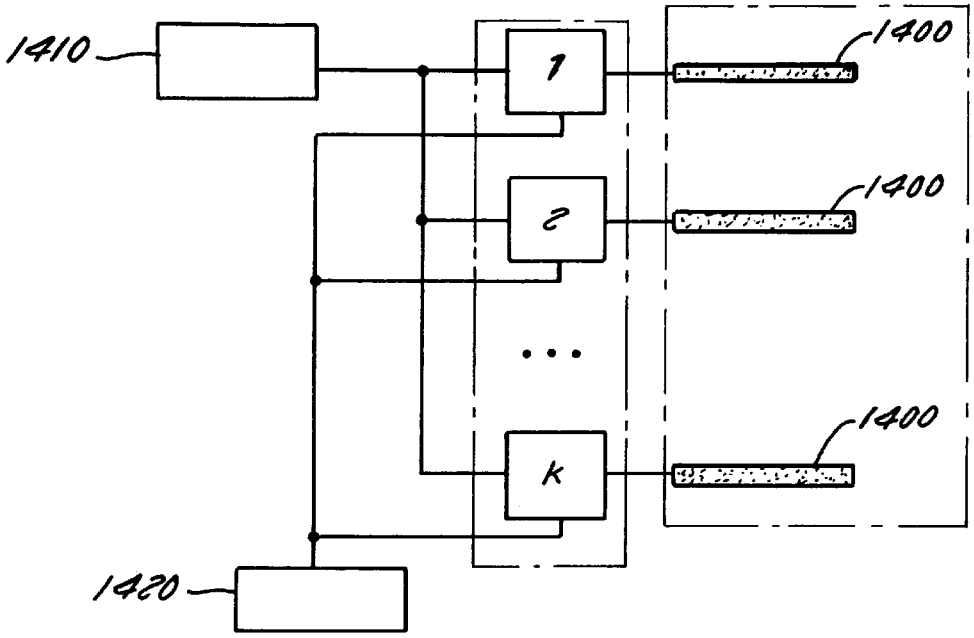
FIG. 14 illustrates a high level control circuitry diagram for a plurality of plasma current injection electrodes, representing an embodiment of the present invention.

To drive the electrode system, a simple circuit can be used such as shown in FIG. 14. Each of a plurality of electrodes 1400 can be driven independently. This allows a flexible grating formation. To form a grating with a desired period and duty cycle, some of the upper electrodes are fed by a pulse generator 1410 through open gates 1, 2 . . . K. A processor 1420 selects the gates that should be opened. The maximum current per electrode can be as low as 10 mA. Pulse duration and duty cycle can vary within wide intervals.

Figure 15B:
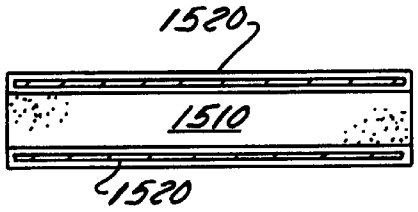
FIGS. 15A–15F illustrate a fabrication sequence for plasma injection electrodes on a semiconductor slab, representing an embodiment of the present invention.
Figure 15D:
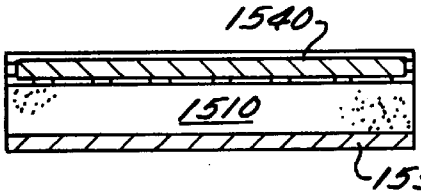
Figure 15F:
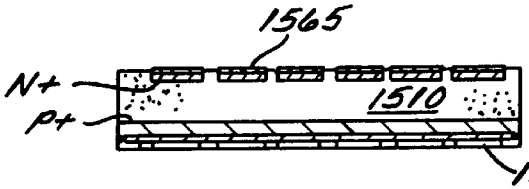
Figure 15A:
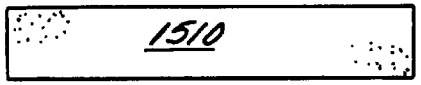
Figure 15C:
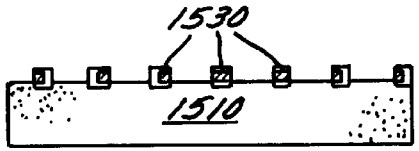
Figure 15E:
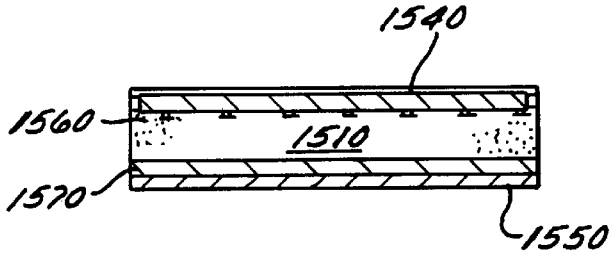

The fabrication of a silicon slab containing an electrode array can include formation of $P^+$ and $N^+$ regions in the slab carried out by standard processes used in microelectronics technology. The schematic fabrication diagram for a $P^+$-I-$N^+$ structure with the use of a diffusion process is shown in FIGS. 15A–15F. In FIG. 15A, a silicon wafer 1510 is shown ready for further processing. The wafer 1510 can be prepared from high resistivity float grown silicon. In FIG. 15B, the silicon wafer 1510 is shown coated with layers of silicon oxide 1520. These layers of silicon oxide 1520 can be readily deposited by oxidation. In FIG. 15C the lower level of silicon oxide has been removed. The upper level of silicon oxide has been processed to form a pattern 1530. The pattern 1530 can be produced using standard photolithographic techniques. In FIG. 15D, the spaces defined by the pattern have been filled and overcoated with an N-type dopant layer 1540. The layer 1540 can contain, for example, phosphorous. The other side of the wafer 1510 is coated with a P-type dopant material layer 1550. The layer 1550 can contain, for example, boron. In FIG. 15E, a simultaneous two-sided step of diffusion is represented by a first region 1560 and a second region 1570. The first region 1560 is located within the wafer 1510 and includes N-type dopant from the layer 1540. The second region 1570 is also located within the wafer 1510, but on its opposite side and includes P-type dopant from the layer 1550. In FIG. 15F, the layers 1540 and 1550 have been stripped away and the pattern 1530 has also been stripped away. The remaining regions 1560 and 1570 have been coated with metal layers 1565 and 1575, respectively. Other processes such as epitaxy or ion implantation can also be used.

Without reference to any particular figure, the dielectric rod that supplies the MMW energy can be made from quartz optical fiber of from approximately 1 to 1.5 mm in diameter. It can be fed through a standard MMW coupler. The resulting slab electrode array can be wired to an electrode control connector and coupled to a controlling device through a flexible flat cable. As the millimeter wavelength source, a Gunn oscillator can be used and if a detector is needed, a GaAs Schottky diode can be used.

Figure 16:
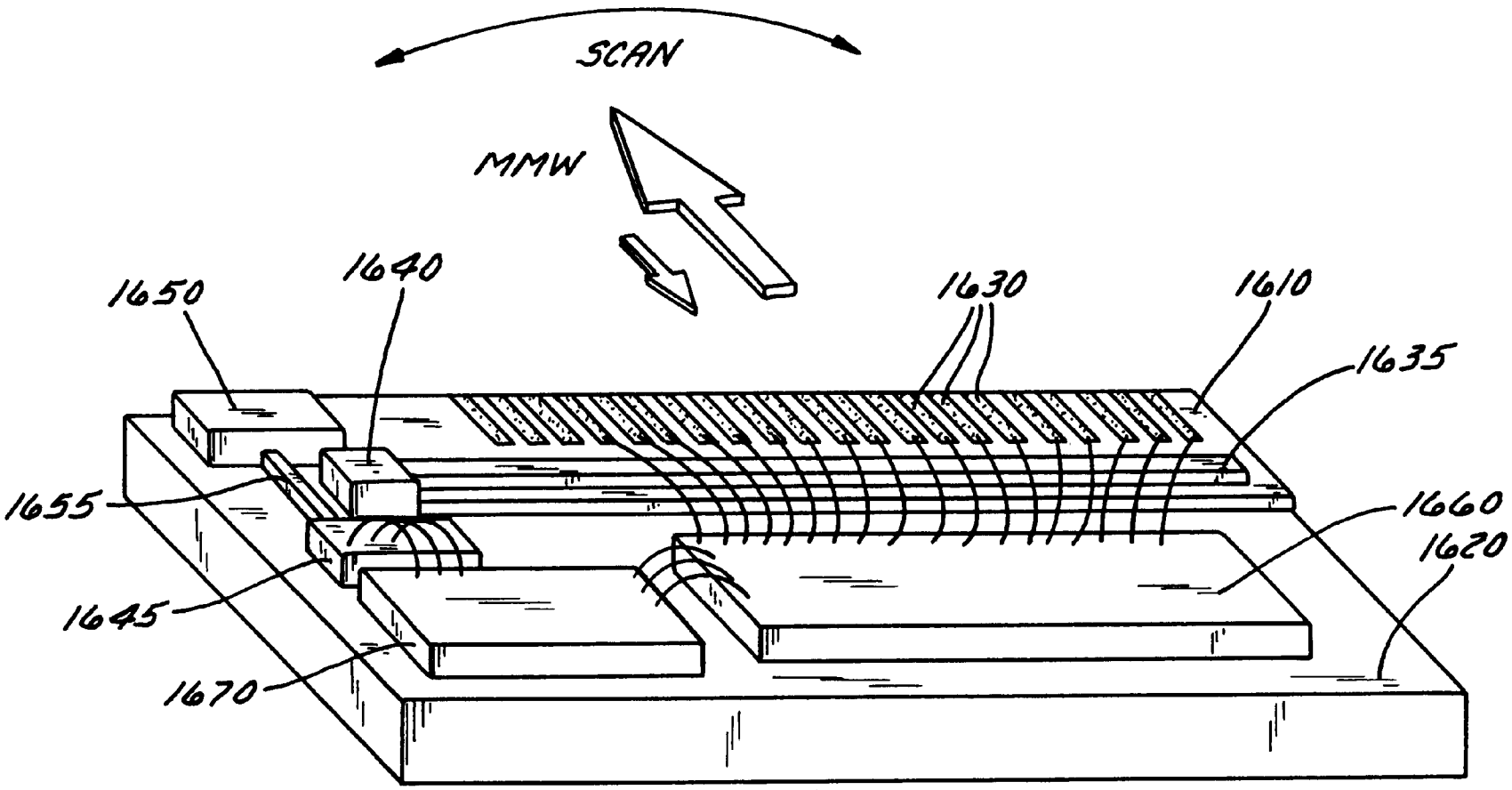
FIG. 16 illustrates a schematic perspective view of a current injected plasma grating antenna integrated into a monolithic radar device, representing an embodiment of the present invention.

Referring to FIG. 16, an antenna assembly 1610 is shown connected to a substrate 1620. The substrate 1620 can be silicon nitride, aluminum nitride, alumina or any other suitable insulating, preferably thermally conducting, material. The antenna and assembly 1610 includes a plurality of switching electrodes 1630. The antenna assembly also includes a rib waveguide 1635 that distributes power along the aperture of the antenna assembly 1610. The rib waveguide 1635 is connected to a circulator 1640. The circulator 1640 is connected to a millimeter wavelength mixer 1645 and a millimeter wavelength source 1650. The millimeter wavelength source 1650 can include a gun oscillator and a power splitter. The millimeter wavelength source 1650 is also connected to the millimeter wavelength mixer 1645 via a clock 1655. Each of the plurality of switching electrodes 1630 is directly wired to a scan controller 1660 with gold wires. The wires need not be gold mat rather need only be made of suitably conductive materials for conveying the signals from the scan controller 1660. The scan controller 1660 is programmed to generate signals that apply appropriate currents and voltages to the different electrodes. The scan controller 1660 is connected to an intermediate frequency and low frequency processor 1670. The processor 1670 includes output terminals and is connected to the millimeter wavelength mixer 1645.

Photon-Injected Plasma Grating Embodiments

Among the advantages of photo-injection is the possibility of using inexpensive, easily controlled and very flexible liquid crystal matrices. It is also possible to effect a remote control of the antenna through the use of optical fibers for patterning the required plasma grating.

An optically controlled antenna preferably includes a separated dielectric waveguide feed and a semiconductor antenna aperture. The semiconductor (silicon) is a photosensitive medium that provides the antenna with the beam steering and beamforming capability through a photo-induced plasma grating. Due to the separate feed, the photo-induced plasma grating does not hamper the millimeter wavelength propagation in the feed, thus permitting the antenna aperture to be of sufficient length, as required for narrow beam operation. The antenna can be remotely controlled via optical fiber. A 2-D optically controlled antenna array can be designed utilizing a stack of 1-D scanning antennas.

Figure 17:
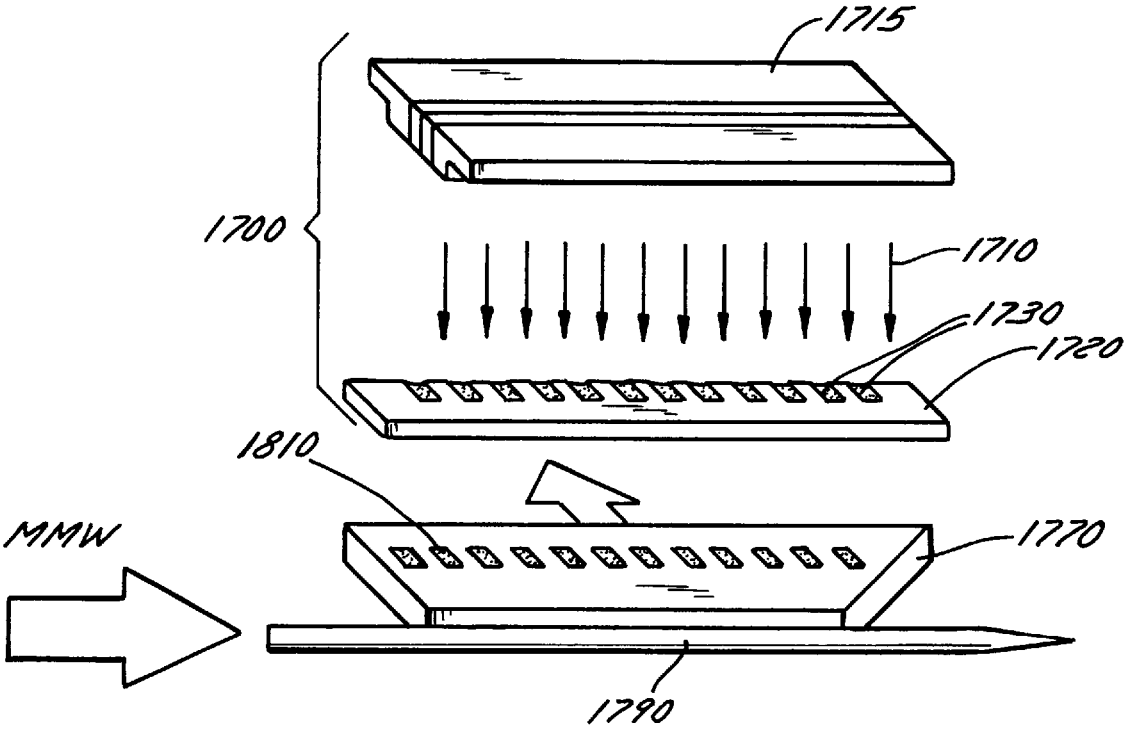
FIG. 17 illustrates a schematic exploded perspective view of an optically controlled scanning antenna that is illuminated by laser through a spatial light modulator, representing an embodiment of the present invention.

Referring to FIG. 17, a photon-injected plasma grating antenna includes a semiconductor slab 1770 with a photo-induced plasma grating 1780, a dielectric waveguide 1790, and an illumination system 1700. The semiconductor slab 1770 can be cut from high resistivity silicon crystal. The dielectric waveguide 1790 can be a quartz rod. The illumination system 1700 includes light 1710 from a semiconductor laser bar 1715 and a photo-mask 1720 with a grating pattern 1730. The photo-mask 1720 can be a liquid-crystal spatial light modulator (SLM). The distance between the illumination system 1700 and the slab 1770 should not be so high as to be absorptive but can be from zero to a large dimension. The light 1710 illuminates the slab 1770 through pattern 1730 in the photo-mask 1720 creating the plasma grating 1780 having the same configuration as the pattern 1730. The semiconductor slab 1770 represents a planar waveguide for the millimeter waves and is the main component of the antenna. The dielectric waveguide 1790 acts as a feeder, coupling the millimeter wavelength signal into the semi-conductor slab 1770.

Figure 18:
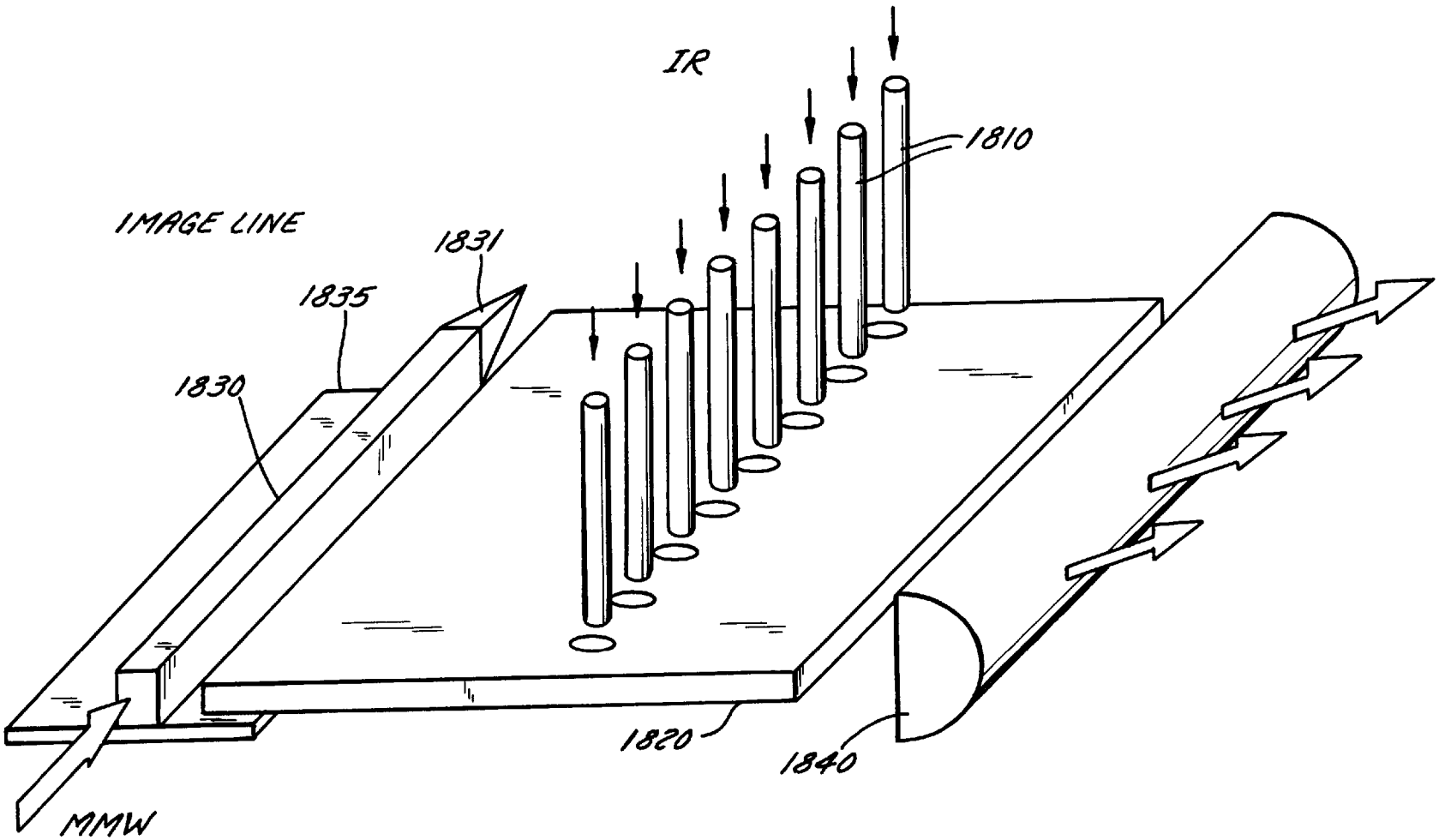
FIG. 18 illustrates a schematic perspective view of a tunnel image line feeder antenna, representing an embodiment of the invention.

Referring now to FIG. 18, a photon injected plasma grating assembly can be activated by an illumination system including a plurality of fiber optics 1810 that are arranged perpendicularly to one facet of a semiconductor slab 1820. A dielectric rod 1830 can be bonded to a ground plate 1835 that is grounded. The ground plate 1835 provides a convenient structure for holding the dielectric rod 1830. The waveguide can be a rectilinear rod, optionally with a taper 1831. The polarization fed into the rod can be TE, TM or circular. The plurality of fiber optics 1810 can be touching the top face of the slab 1820 or be spaced slightly apart from the slab 1820. A cylindrical prism lens 1840 can be provided. This configuration depicted in FIG. 18 can be termed an image line.

Figure 19:
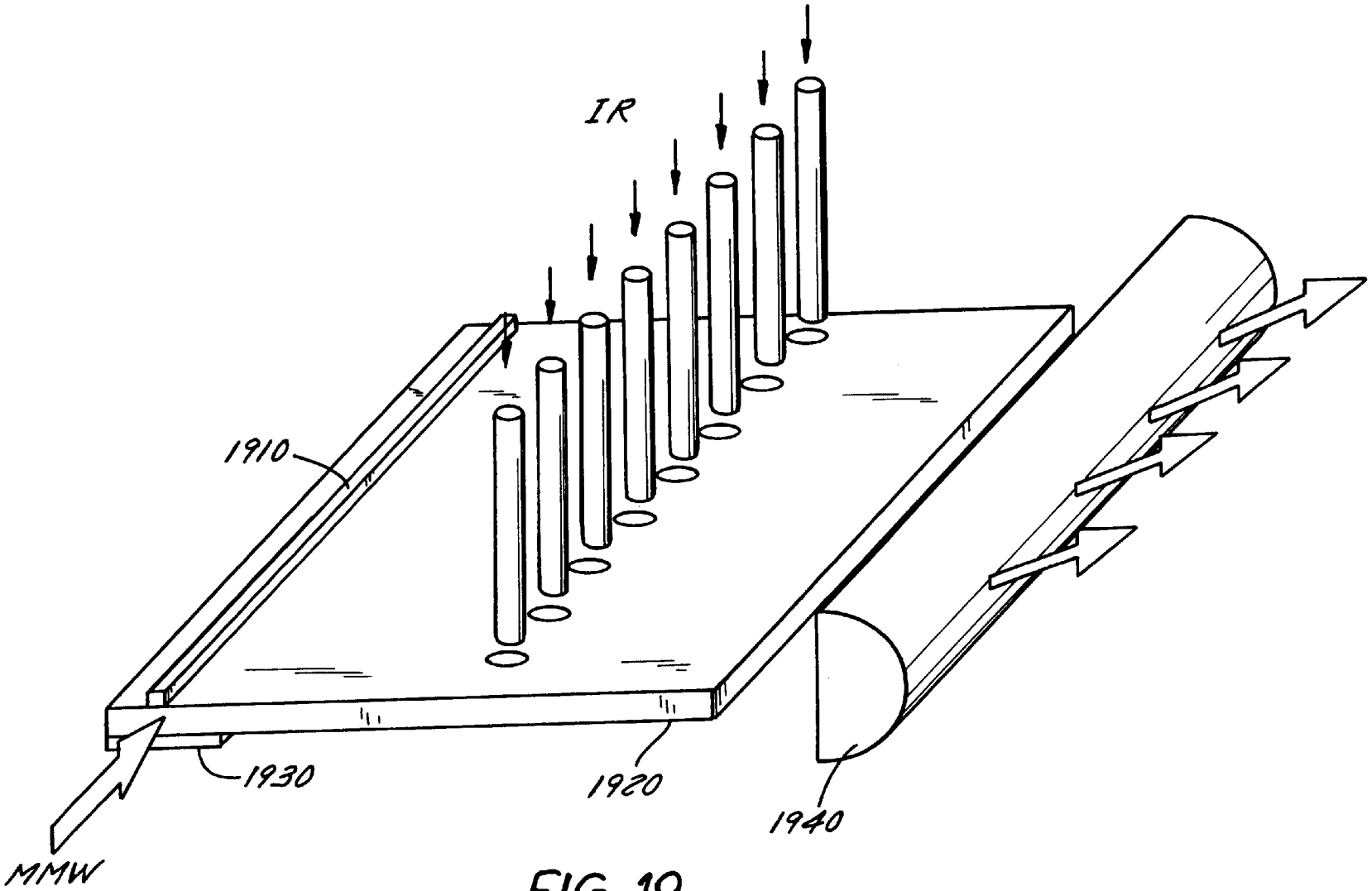
FIG. 19 illustrates a schematic perspective view of a microstrip line feeder antenna, representing an embodiment of the invention.

Referring now to FIG. 19, instead of a separate dielectric feed, a microstrip line waveguide 1910 can be provided directly on top of a slab 1920. A metal ground plate 1930 is provided opposite the microstrip line waveguide 1910. In this embodiment, an illumination system for emitting light, from the infrared (IR) spectra is being used to generate the photon injected plasma grating within the slab 1920. Again a cylindrical prism lens 1940 can be provided.

Figure 20:
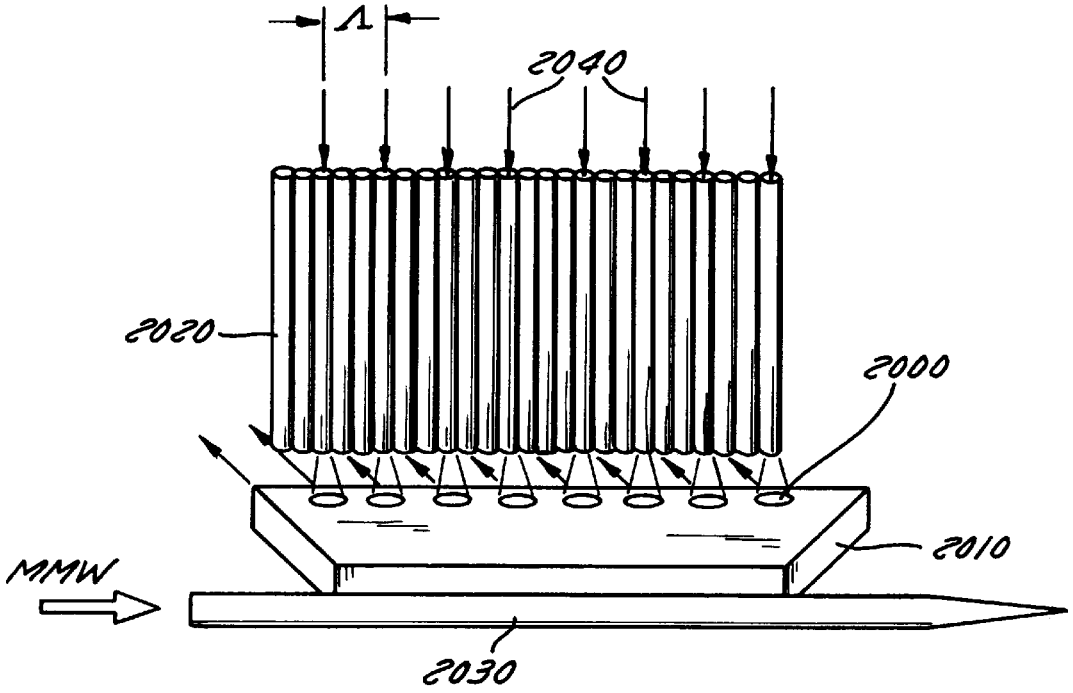
FIG. 20 illustrates a schematic perspective view of an antenna with an illuminating scheme implemented by a fiber optic set, representing an embodiment of the invention.

Referring now to FIG. 20, a photon injected plasma grating 2000 can be generated in a semiconductor slab 2010 using an illumination system including a fiber set 2020 that is spatially arranged perpendicularly to an upper facet of the slab 2010. Millimeter wavelength energy is conveyed into a dielectric waveguide 2030 and coupled into the slab 2010. Pumping light 2040 is directed toward the slab 2010 through the fiber set 2020. The photo injected plasma grating 2000 is generated within the slab 2010 by the interaction of the pumping light 2030 with the semiconductor material from which the slab 2010 is fabricated. By controlling which of the plurality of perpendicular fiber optics is illuminated, the required grating spacing $\Lambda$ can be conveniently controlled. By rapidly switching between alternative sets of illuminated optics, the beam can be scanned.

Figure 21A:
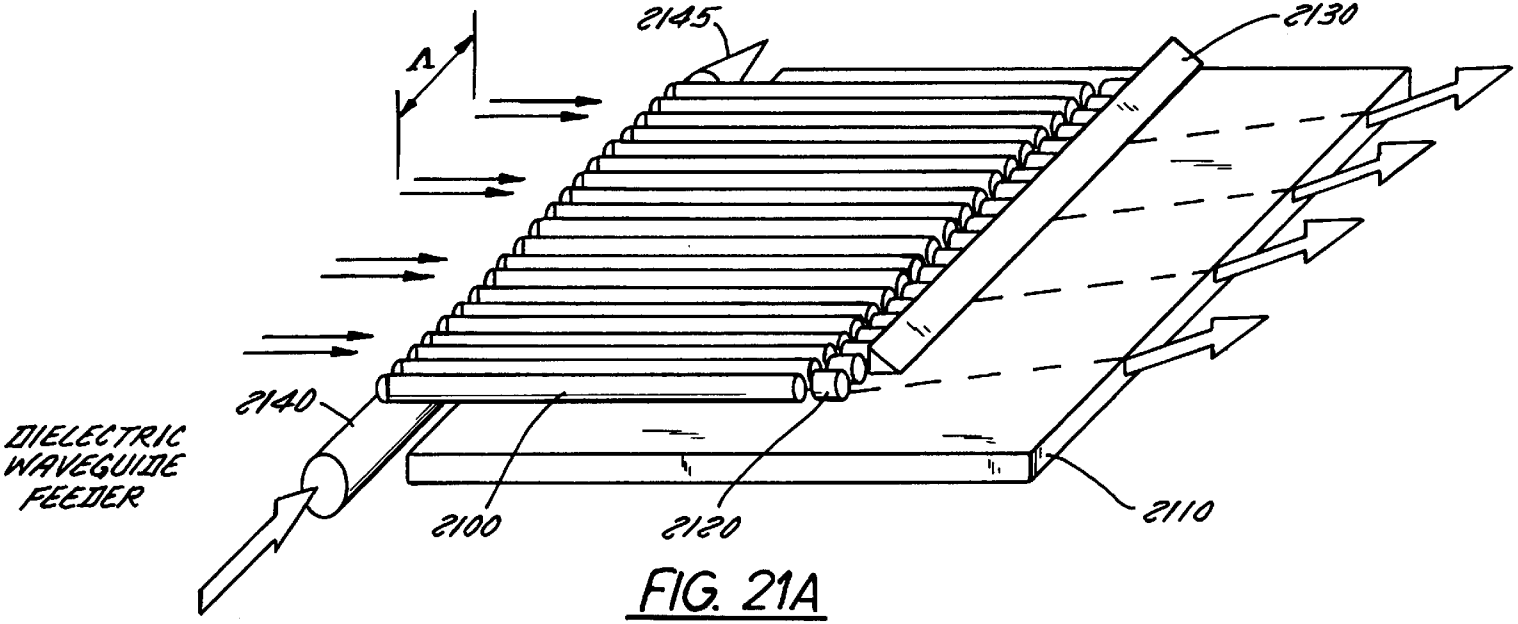
FIG. 21A illustrates a schematic perspective view of an antenna with quasi-planar packaging and fiber optic illumination, representing an embodiment of the invention.
Figure 21B:
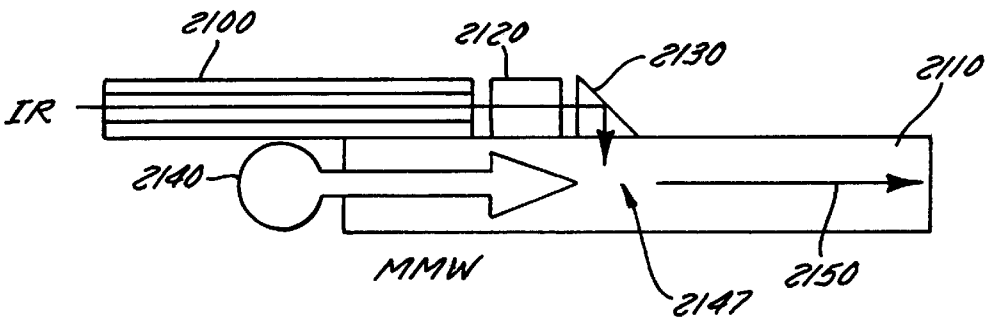
FIG. 21B illustrates a schematic sectional view of the antenna depicted in FIG. 21A.

Referring now to FIGS. 21A–21B, an illumination system including a plurality of fiber optics 2100 are arranged with their axes parallel to a facet of a semiconductor slab 2110. A graded refractive index lens 2120 is placed at the terminus of each of the optical fibers. The grated refractive index lens 2120 helps keep the light from spreading. Light from the fibers that passes through the grated refractive index lens is then redirected through a strip prism 2130. Referring to FIG. 21A, a dielectric waveguide feeder 2140 provides the source of millimeter wavelength energy for coupling into the slab 2110. The dielectric waveguide feeder 2140 includes a tapered end 2145. Referring to FIG. 21B, the flux that is coupled into the slab 2110 from the dielectric waveguide feeder 2140 can be appreciated to diminish as a result of its interaction with plasma 2147. This is represented by the smaller arrow 2150.

Figure 22:
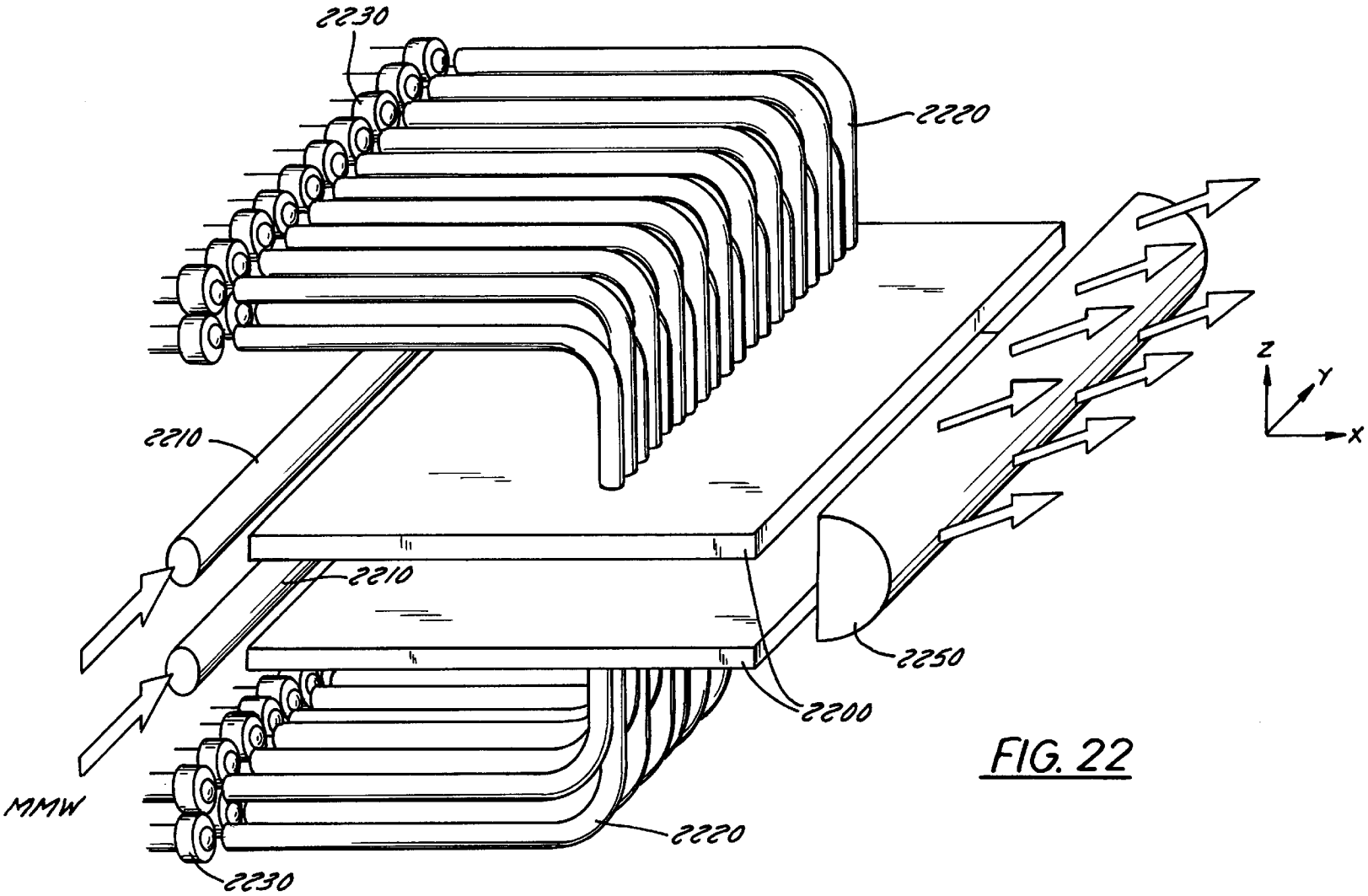
FIG. 22 illustrates a schematic perspective view of a monopulse design 2-D scanning antenna with scanning in the vertical Y, and horizontal Z, planes representing an embodiment of the invention.

Referring now to FIG. 22, an illumination system including a plurality of optically controlled slabs can be provided in a vertical arrangement. This provides for vertical scanning of the resultant array. In the depicted embodiment, a set of two slabs 2200 are controlled by two corresponding sets of optical fibers 2220. Each of the sets of optical fibers includes two parallel banks that are powered by an array of light emitting laser diodes 2230. To condense the array format of the diodes, the two dimensional array is geometrically transformed through a tight radius right turn into a one dimensional array. This geometrical transformation takes place on both sides of the plurality of slabs. Each of the slabs is powered by a corresponding dielectric waveguide 2210. The focal point between the slabs 2200 should be close to their end faces and relatively centered within the space between the slabs. Again, a cylindrical prism lens 2250 can be provided.

Figure 23:
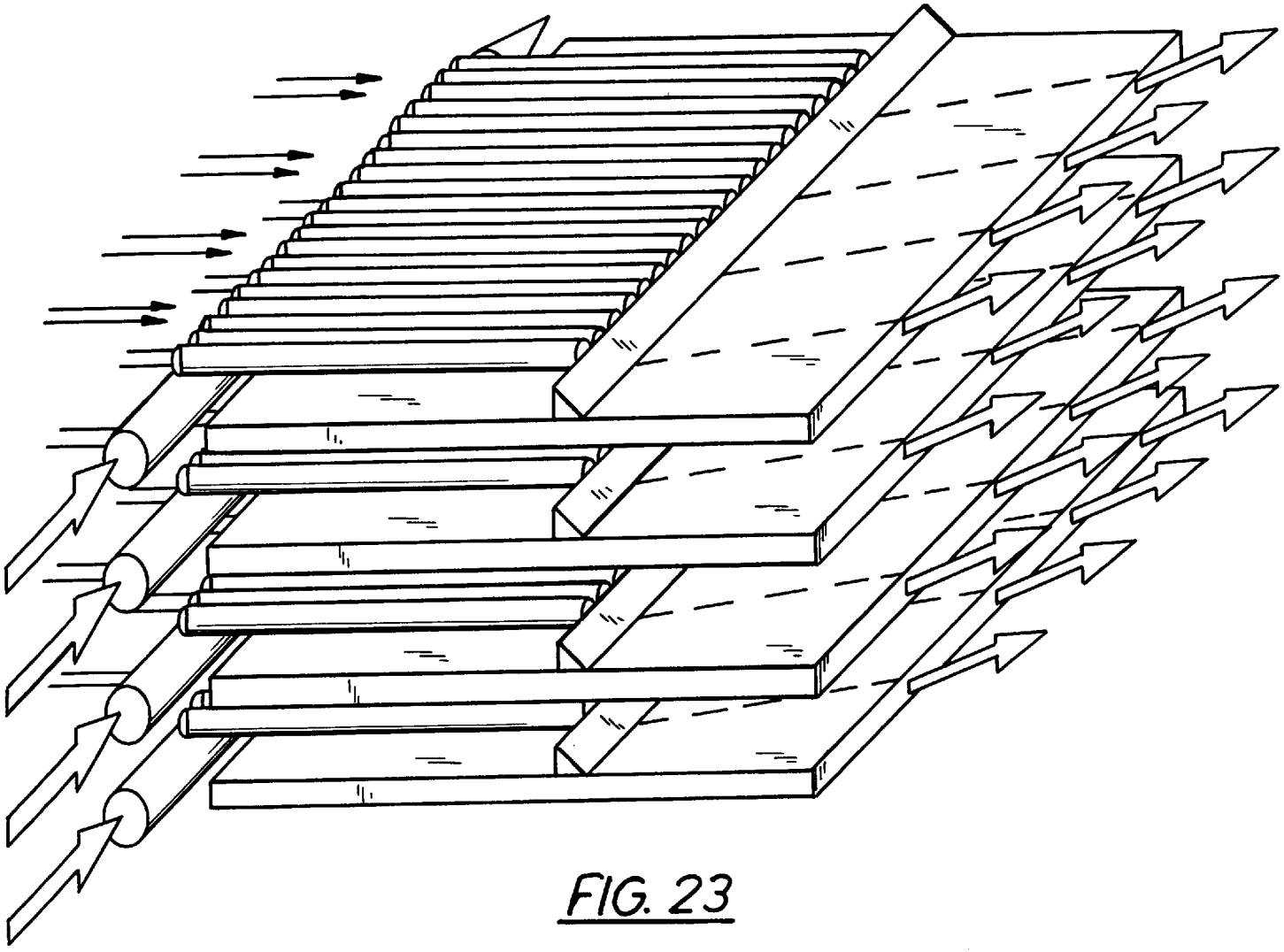
FIG. 23 illustrates a schematic perspective view of a 2-D scanning antenna configured as a phased array in the vertical plane, representing an embodiment of the invention.

Referring now to FIG. 23, a set of four slabs is provided with parallel runs of fiber optics that are each arranged parallel to the plane of their corresponding slabs. This compact design permits stacking a large number of slabs in a relatively small volume.

Figure 8:
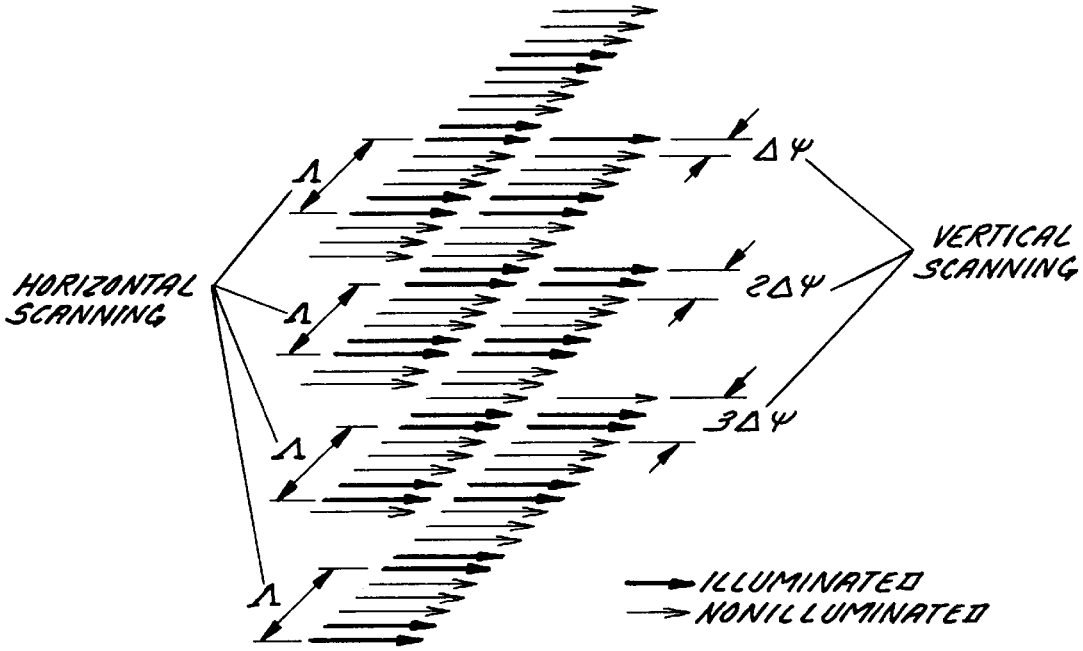
FIG. 8 illustrates a schematic perspective view of an illuminating scheme for a fiber-optic array delivering light to a two dimensional (2D) scanning antenna. representing an embodiment of the invention.

Referring now to FIG. 8, a two-dimensionally scanning antenna can be based on separate control of the horizontal and vertical scanning of an array of antenna elements according to the invention. The angle of horizontal scanning is controlled by the parameter $\Lambda$. The angle of vertical scanning is controlled by the increment parameter $\Delta\psi$.

EXAMPLES

Specific embodiments of the present invention will now be further described by the following, nonlimiting, examples which will serve to illustrate various features of significance. The examples are intended merely to facilitate an understanding of ways in which the present invention may be practiced and to further enable those of skill in the art to practice the present invention. Accordingly, the examples should not be construed as limiting the scope of the present invention.

A silicon waveguide was cut from a high resistivity silicon ingot grown by a float-zone technique. The waveguide thickness was 17.5 mil., (0.0175 inch), forming a silicon wafer which was polished on both sides. This wafer waveguide acted as a single mode planar waveguide where both the $TE_0$ or $TM_0$ modes could propagate. A dielectric waveguide feeder was provided in the form of a circular quartz rod coupled to a millimeter wavelength source (a Gunn oscillator) that generated a millimeter wavelength signal with linear polarization. This polarization was maintained by the circular dielectric waveguide up until coupling with the waveguide.

It follows from the standard treatment of the planar waveguide that the propagation constants for the $TE_0$ and $TM_0$ modes in the waveguide are quite different. In the experiment, which was performed at a test frequency of 90 GHz, the respective propagation constants were found to be $\beta_{TE}$=51.3 $cm^{-1}$ and $\beta_{TM}$=26.7 $cm^{-1}$. The total internal reflection condition for these two modes is different because the propagation angles are different. These facts determined the choice of two different experimental geometries for the silicon plate width W and the terminal angle $\alpha$. For TE polarization, W=1.5 inches, $\alpha$=40.5 degrees. For TM polarization W=0.51 inches and $\alpha$=24 degrees. The slab terminal angle $\alpha$ provided close to normal incidence for the total internal reflection (TIR) beam. This geometry, along with a tapered edge on the slab assured removal of the unwanted TIR beam C ("0" order) and minimized its contribution to the output beam. Measurements were performed for two output polarizations, which were identical to the two input polarizations provided by deconstruction of the millimeter wavelength source. These polarizations were maintained in the respective antenna configuration.

The photon-injected plasma gratings in this example were generated by illuminating the silicon planar waveguide through photo-masks with four different grating periods: $\Lambda$=0.091, 0.103, 0.120 and 0.142 inches. The photo-induced plasma gratings were excited close to the upper edge of the slab. The periods of the photo-induced plasma gratings differed slightly from that of the photo-masks because the photo-masks were slightly rotated (individually for each grating and each polarization) to obtain maximum efficiency. The source of illumination was a stroboscopic arc lamp. The lamp produced pulses with a duration of 2 $\mu$sec, at a repetition rate of 100 Hz, and energy density of 0.5 $(10)^{-4}$ joule/$cm^2$ per pulse at the silicon surface.

The radiating aperture of the antenna in the scanning plane is defined by the waveguide length and by the length of the tunnel coupling between the quartz rod and the slab. In the scanning direction, the aperture size was approximately 30 mm. To form the millimeter wavelength beam in the perpendicular direction, a cylindrical lens (1 inch in diameter) was used.

Figure 24:
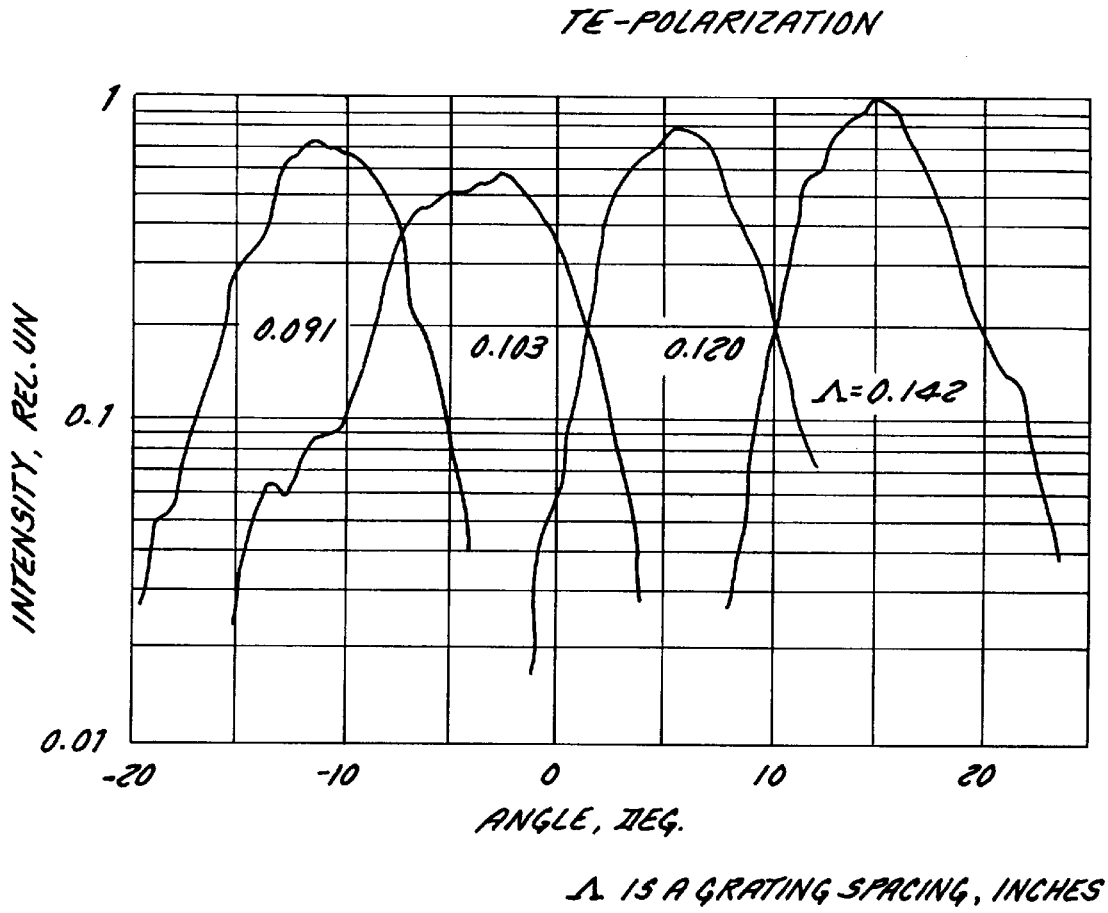
FIG. 24 illustrates four far field antenna patterns from a scanning antenna corresponding to four different grating periods for an antenna operating with TE polarization, representing an embodiment of the present invention.
Figure 25:
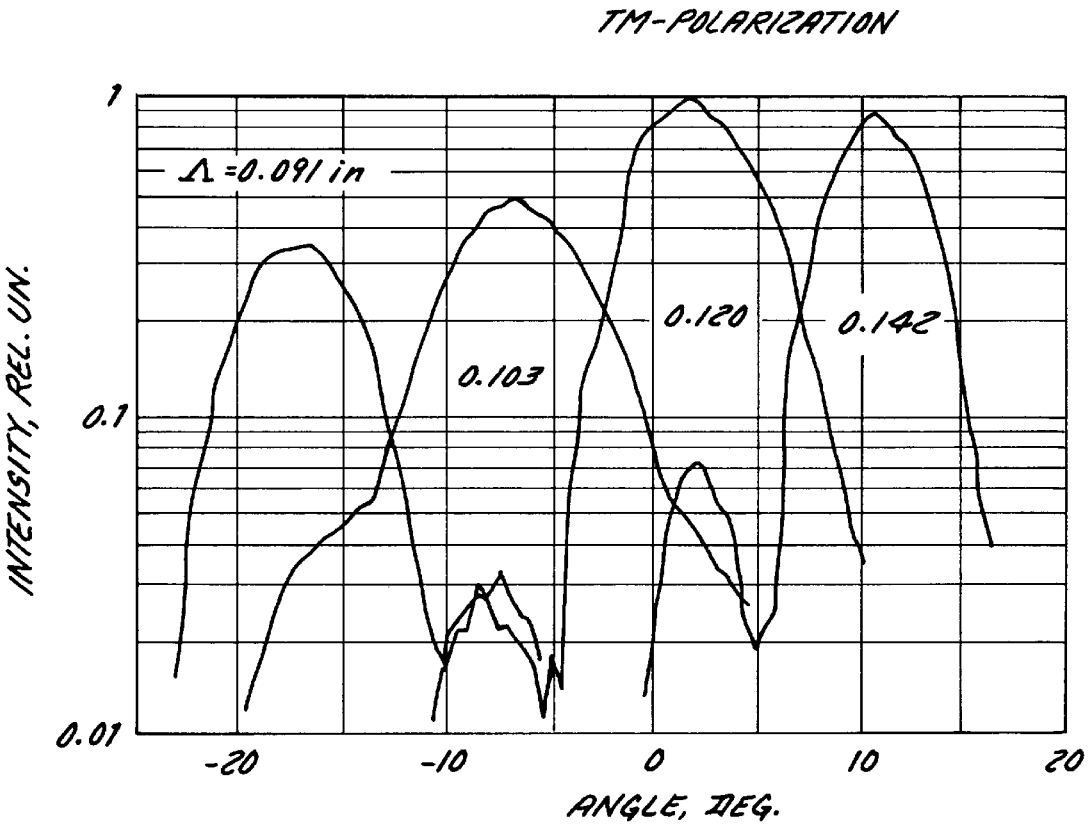
FIG. 25 illustrates four far field antenna patterns from a scanning antenna corresponding to four different grating periods for an antenna operating with TM polarization, representing an embodiment of the present invention.

The antenna was tested in both the transmitting and the receiving modes. In both modes, the antenna performance was similar. The far field antenna patterns for two orthogonal polarizations are shown in FIGS. 24 and 25. The directions of the output beams were in good agreement with the predictions based on Eq. (6), assuming that $\beta_{wg}$ is close to the theoretical value, of 20.2 $cm^{-1}$. Any small differences in angular positions between the two polarizations can be explained by different alignment of the photo-masks required to achieve maximum antenna efficiency. In comparison with a standard horn antenna, the estimated gain of the photo-induced plasma grating based antenna was approximately 17 dB.

| Performance Parameters | |
|---|---|
| Operation Frequency | 90 GHz |
| Operation Mode | Receiving or Transmitting |
| Steering Control | Optical |
| Output Aperature | 1" × 1" |
| Steering Angular Coverage | >30° |
| Gain | 17 dB |
| −3 dB Beamwidth | 6° |
| Sidelobe Level | <−15 dB |
| Polarization Options: | Linear (Horizontal or Vertical), or Circular |

The antenna is operable in both transmitting and receiving modes, while showing approximately the same gain (16–17 dB). It can operate with both vertical and horizontal polarization. It can even transform the linearly polarized input beam into an output beam with circular polarization, which is a very significant feature of the invention.

To prove the circular polarization concept, a planar slab waveguide with a width W=0.756 inches was obtained. According to calculations, this slab provides a phase difference of $\pi/2$ between the $TE_0$ and $TM_0$ modes at the emitting surface of the slab. A linearly polarized millimeter wavelength source was set up to feed radiation into a circular dielectric waveguide at a polarization angle, p≈45 degrees. The slab was illuminated through a photo-mask with a grating period of $\Lambda$=0.120 inches. To perform the measurements, the following instrument was constructed. A circular horn antenna with an attached detector was mounted on a rotating base with an axis coinciding with the axis of the horn. It was installed in the far-field region of the exemplary antenna, in the direction of the main lobe.

The output beam was found to be initially elliptically polarized. It was then changed to circular polarization by adjusting the difference in the overall propagation amplitude of the two orthogonal modes, taking into account the difference in diffraction efficiency as each of the two modes interacted with the photo-induced plasma grating.

Figure 26A:
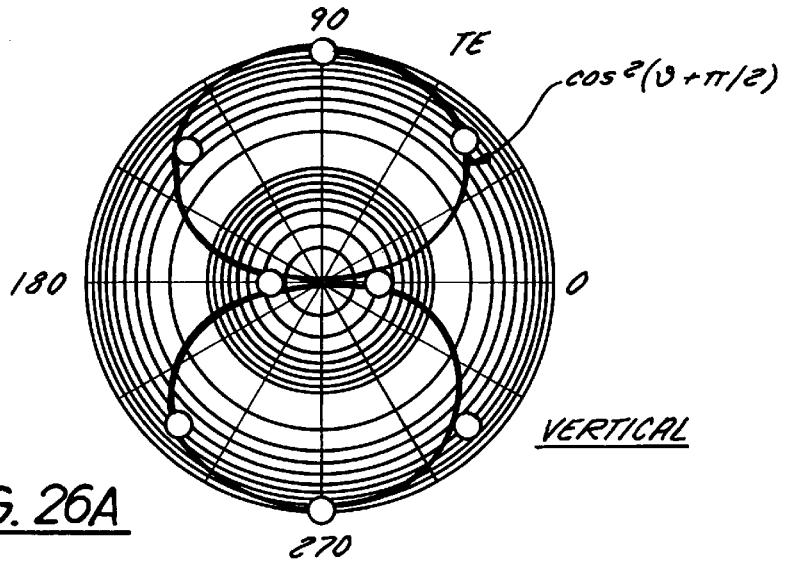
FIGS. 26A–26C illustrate log plots of the output intensity from a scanning antenna as a function of the detector polarization angle for three different modes (i.e., TE, TM, and circular, respectively), representing an embodiment of the invention.
Figure 26B:
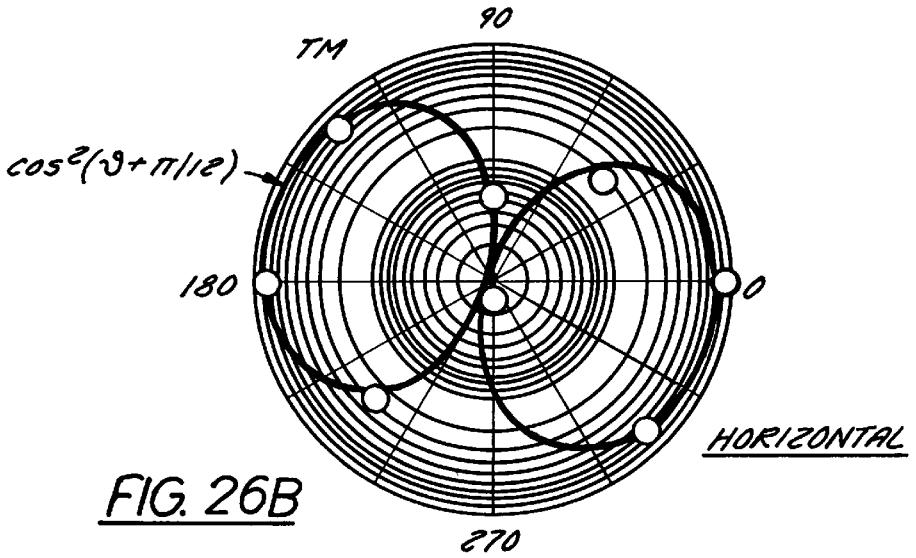
Figure 26C:
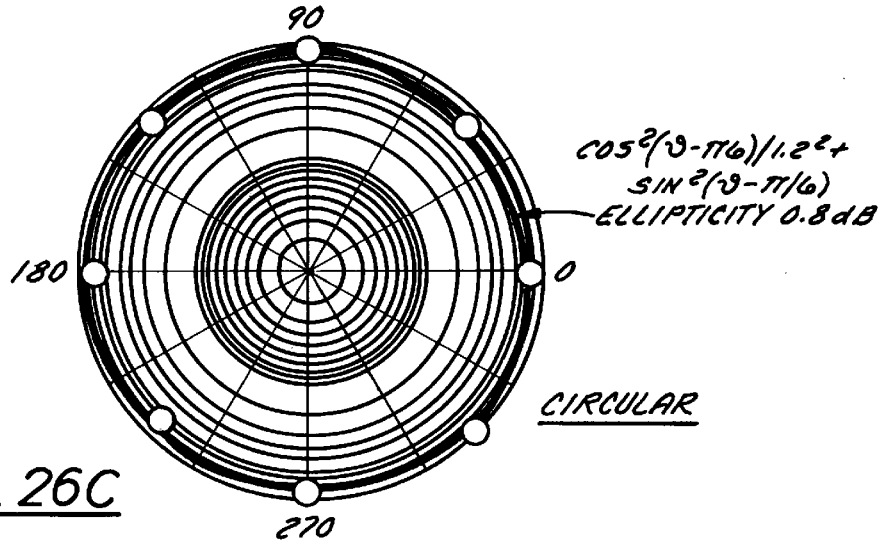

Referring to FIGS. 26A–26C, by tuning the angle, $\rho$, of the millimeter wavelength radiation source, excellent circularity was obtained in the output beam. The remaining ellipticity was less than 0.8 dB, as seen in FIG. 26C. When the input millimeter wavelength radiation was polarized in the plane of the slab ($\rho$=0) or perpendicular to that plane ($\rho$=90°), the intensity of the output beams obeyed the cosine square law, confirming linear polarization, as illustrated by FIGS. 26A and 26B, respectively.

Practical Applications of the Invention

A practical application of the present invention which has value within the technological arts is as an antenna for a automobile, aircraft, or other vehicle, collision avoidance system. The cost of a millimeter integrated circuit antenna is expected to be orders of magnitude smaller than that of its phased array counterparts. This will open new opportunities for antenna applications both in the traditional use (radar and communications) and in new emerging technologies (MMW imaging, aircraft landing, concealed weapons detection). Further, the present invention is useful in conjunction with systems such as are used for the purpose of target seeking, or for the purpose of concealed weapons detection, or the like. There are virtually innumerable uses for the present invention described herein, all of which need not be detailed here.

Although the best mode contemplated by the inventors of carrying out the present invention is disclosed above, practice of the present invention is not limited thereto. It will be manifest that various additions, modifications and rearrangements of the features of the present invention may be made without deviating from the spirit and scope of the underlying inventive concept. Accordingly, it will be appreciated by those skilled in the art that, within the scope of the appended claims, the invention may be practiced otherwise than as specifically described herein.

Moreover, the individual components need not be formed in the disclosed shapes, or assembled in the disclosed configuration, but could be provided in virtually any shape, and assembled in virtually any configuration, which cooperate so as to provide a scanning capability. Further, although the antenna described herein is a physically separate module, it will be manifest that the antenna may be integrated into the apparatus with which it is associated. Furthermore, all the disclosed features of each disclosed embodiment can be combined with, or substituted for, the disclosed features of every other disclosed embodiment except where such features are mutually exclusive.

It is intended that the appended claims cover all such additions, modifications and rearrangements. Expedient embodiments of the present invention are differentiated by the appended subclaims.

What is claimed is:

1. An apparatus comprising:

a semiconductor plate having an output edge;

a plasma grating excited within said semiconductor plate and having a selectable period $\Lambda$; and wherein a primary electromagnetic beam propagates in said semiconductor plate at a propagation angle $\gamma$ with respect to a direction normal to said output edge of said semiconductor plate, wherein said plasma grating steers said primary electromagnetic beam, and wherein $\gamma$ is larger than a total internal reflection angle of said output edge.

2. The apparatus according to claim 1, further comprising a spatial light modulator arranged generally parallel to said semiconductor plate, and a light source arranged generally parallel to said spatial light modulator such that said spatial light modulator is disposed generally between said semiconductor plate and said light source.

3. The apparatus according to claim 1, further comprising an array of fiber optics each having an output end disposed generally adjacent to said semiconductor plate, said fiber optics for receiving light energy from a corresponding set of independently controlled light sources.

4. The apparatus according to claim 1, wherein a width of said semiconductor plate, W, is approximately equal to $m\pi\cos\gamma/\beta_{sl}$ so as to facilitate constructive interference between said primary electromagnetic beam and a back reflected beam, and wherein m is an integer, $\gamma$ is the propagation angle, and $\beta_{sl}$ is a propagation constant for millimeter wavelength energy within said semiconductor plate.

5. The apparatus according to claim 1, further comprising a dielectric rib waveguide disposed generally adjacent said semiconductor plate.

6. The apparatus according to claim 1, further comprising a tunnel feeder including a dielectric rod arranged generally adjacent to said semiconductor plate to couple said primary electromagnetic beam into said semiconductor plate.

7. The apparatus according to claim 1, further comprising a microstrip line feeder, wherein said semiconductor plate has opposed sides and said microstrip line feeder includes (1) a waveguide arranged on one of said opposed sides and (2) a ground plate arranged on the other of said opposed sides, generally opposite said waveguide.

8. An apparatus comprising:

a semiconductor plate having an output edge;

a plasma grating;

a horn feeder contiguously connected to said semiconductor plate, said horn feeder including a signal broadening section, a signal directing section and metallic layers; and wherein a primary electromagnetic beam propagates in said semiconductor plate at a propagation angle $\gamma$ with respect to a direction normal to said output edge, and wherein $\gamma$ is larger than a total internal reflection angle of said output edge.

9. An apparatus for outputting a steered output beam, the apparatus comprising:

a semiconductor plate having an output edge; and a plurality of current injection electrodes connected to said semiconductor plate, said plurality of current injection electrodes being adapted to inject a plasma grating into said semiconductor plate, and wherein a primary electromagnetic beam propagates in said semiconductor plate at a propagation angle $\gamma$ with respect to a direction normal to the output edge, and wherein said plasma grating steers said primary electromagnetic beam to produce the steered output beam.

10. The apparatus according to claim 9, wherein a width of said semiconductor plate, W, is approximately equal to $m\pi\cos\gamma/\beta_{sl}$ so as to facilitate constructive interference between said primary electromagnetic beam and a back reflected beam, and wherein m is an integer, $\gamma$ is the propagation angle, and $\beta_{sl}$ is a propagation constant for millimeter wavelength energy within said semiconductor plate.

11. The apparatus according to claim 9, further comprising a dielectric rib waveguide disposed generally adjacent said semiconductor plate.

12. The apparatus according to claim 9, further comprising a tunnel feeder including a dielectric rod being arranged generally adjacent to said semiconductor plate to couple the electromagnetic beam into said semiconductor plate.

13. The apparatus according to claim 9, further comprising a microstrip line feeder, wherein said semiconductor plate has opposed sides and said microstrip line feeder includes (1) a waveguide arranged on one of said opposed sides and (2) a ground plate arranged on the other of said opposed sides, generally opposite said waveguide.

14. An apparatus comprising:

a semiconductor plate having an output edge;

a plurality of current injection electrodes connected to said semiconductor plate, said plurality of current injection electrodes being adapted to inject a plasma grating into said semiconductor plate;

a horn feeder contiguously connected to said semiconductor plate, said horn feeder including a signal broadening section, a signal directing section and metallic layers; and wherein a primary electromagnetic beam propagates in said semiconductor plate at a propagating angle $\gamma$ with respect to a direction normal to the output edge.

15. A method of transforming a linearly polarized signal into a circularly polarized signal comprising:

coupling a linearly polarized signal comprising the superposition of TM and TE polarization modes from a dielectric waveguide into a semiconductor slab wherein the width, W, of said semiconductor slab is determined so that $$W=(\pi/2+\pi m)/(\beta_{TM}/\cos\gamma_{TM}-\beta_{TE}/\cos\gamma_{TE})$$

where m is an integer, $\beta_{TM}$ and $\beta_{TE}$ are propagation constants for said TM and TE polarization modes within said semiconductor slab and $\gamma_{TM}$ and $\gamma_{TE}$ are coupling angles for said TM and TE polarization modes.

16. A method of operating a plasma grating antenna to output a steered electromagnetic beam, the method comprising the steps of:

providing a plurality of electrode sets arranged on a semiconductor slab having an output edge;

applying current to selected ones of said electrode sets to form a plasma grating in said semiconductor slab, said plasma grating having a period $\Lambda$;

driving at least one of said plurality of electrode sets at a lower current than the remainder of said plurality of electrode sets so as to suppress side lobes of the steered electromagnetic beam; and varying the period $\Lambda$ by applying current to different selected ones of said electrode sets so as to cause the steered output beam to scan an area.

17. A millimeter wavelength scanning antenna that operates based on diffraction of a primary beam by a modulated plasma grating, said antenna comprising:

a semiconductor propagation medium;

a plasma diffraction grating in said semiconductor propagation medium, said plasma grating having a period $\Lambda$; and a modulator for generating the plasma grating in said semiconductor propagation medium and for selectively varying $\Lambda$ so as to direct said primary beam.

18. The millimeter wavelength scanning antenna according to claim 17 wherein said semiconductor propagation medium further comprises an output border and wherein said primary beam propagates through said semiconductor propagation medium at an angle $\gamma$ with respect to a direction normal to said output border, wherein $\gamma$ is greater than the angle at which total internal reflection occurs in said medium.

19. The millimeter wavelength scanning antenna according to claim 17 further comprising a dielectric waveguide for feeding an input beam to said millimeter wavelength scanning antenna.

20. The millimeter wavelength scanning antenna according to claim 19 wherein said dielectric waveguide is a quartz rod.

21. The millimeter wavelength scanning antenna according to claim 19 wherein the propagation constant of said dielectric waveguide is smaller than the propagation constant of said semiconductor propagation medium.

22. The millimeter wavelength scanning antenna according to claim 19 wherein said dielectric waveguide and said semiconductor propagation medium are arranged so as to collectively define an angle $\zeta$ such that the coupling between said dielectric waveguide and said semiconductor propagation medium has a strength distribution that fills the entire antenna aperture so as to optimize the beam pattern of the outgoing radiation beam.

23. The millimeter wavelength scanning antenna according to claim 17, wherein said modulator includes a plurality of electrodes arranged on said semiconductor propagation medium, and wherein the period Λ is varied by selectively applying current to different ones of said electrodes.

24. The millimeter wavelength scanning antenna according to claim 23, wherein said electrodes include a plurality of upper electrodes 1 through n and a lower electrode which is grounded.

25. The millimeter wavelength scanning antenna according to claim 17, further including a dielectric waveguide independent of said semiconductor propagation medium, and wherein said modulator includes an illumination system that is adapted to generate said plasma grating.

26. A method of generating a diffraction grating in a semiconductor propagation medium, the method comprising the following steps:

generating an electron hole plasma grating in said propagation medium by photon injection;

changing the dielectric constant in said propagation medium;

changing the optical constants for millimeter wavelength and absorption coefficients within said propagation medium where the plasma grating exists;

diffracting a primary millimeter wavelength beam within said propagation medium by the plasma grating;

steering said primary millimeter wavelength beam so as to form a steered output beam by changing the grating period Λ of the plasma grating in said propagation medium.

27. A method according to claim 26, further comprising the step of utilizing total internal reflection to filter from the output beam the zero order beam as well as all positive ordered beams.

28. The method according to claim 27, wherein said propagation medium includes an output border.

29. The method according to claim 28, wherein said output border comprises an interface between said propagation medium and a second medium having a different propagation constant.

30. The method according to claim 29, wherein said second medium having said different propagation constant comprises ambient air.

31. The method according to claim 26, further comprising directing said primary millimeter wavelength beam to propagate in said propagation medium at an angle γ defined with respect to a normal to an output border of said propagation medium, wherein γ is greater than a total internal reflection angle of said propagation medium.

32. A millimeter wavelength scanning antenna that operates based on diffraction of a primary beam by a modulated plasma grating, said antenna comprising:

a semiconductor propagation medium;

a plasma diffraction grating in said semiconductor propagation medium having a period Λ;

a modulator for generating the plasma grating in said semiconductor propagation medium and for varying Λ so as to direct said primary beam; and wherein said semiconductor propagation medium comprises a stripline horn feeder.

33. The millimeter wavelength scanning antenna according to claim 27 wherein said stripline horn feeder includes a signal broadening section and a signal direction section.

34. The millimeter wavelength scanning antenna according to claim 33, wherein said stripline horn feeder is provided with layers of copper foil to facilitate formation of said primary beam.

35. A millimeter wavelength scanning antenna that operates based on diffraction of a primary beam by a modulated plasma grating, said antenna comprising:

a semiconductor propagation medium;

a plasma diffraction grating in said semiconductor propagation medium having a period Λ;

a modulator for generating the plasma grating in said semiconductor propagation medium and for varying Λ so as to direct said primary beam; and wherein said semiconductor propagation medium comprises a slab having a tapered facet oriented at an angle so as to allow beams reflected from the surface of said output border to leave said slab with a minimum of reflection.

36. A millimeter wavelength scanning antenna that operates based on diffraction of a primary beam by a modulated plasma grating, said antenna comprising:

a semiconductor propagation medium;

a plasma diffraction grating in said propagation medium having a period Λ;

a modulator for generating the plasma grating in said propagation medium and for varying Λ so as to direct said primary beam; and wherein said propagation medium comprises a semiconductor plate having a width W wherein W is selected such that internally reflected beams are back reflected in exactly whole multiples of wavelengths, as expressed by the relationship $2W\beta_{sl}/\cos\gamma=2\pi m$ where m is an integer, γ is the propagation angle, and $\beta_{sl}$ is the propagation constant for millimeter wavelength energy within said semiconductor plate.

37. A method of operating a microwave scanning antenna comprising a plasma diffraction grating formed in a planar slab semiconductor waveguide, comprising the following steps:

injecting a linearly polarized microwave beam at an angle ρ into a planar slab semiconductor waveguide to excite two orthogonal modes TE and TM, having distinct propagation constants $\beta_{TE}$ and $\beta_{TM}$ and propagating through said slab at different angles $\gamma_{TE}$ and $\gamma_{TM}$;

deflecting said modes by modulating said plasma diffraction grating;

selecting the width of said semiconductor waveguide such that the phase difference between said TE and TM modes at an output aperture of said semiconductor waveguide is π/2, thereby causing an output beam to be circularly polarized.

38. A millimeter wavelength scanning antenna that operates based on diffraction of a primary beam by a modulated plasma grating, said antenna comprising:

a semiconductor propagation medium;

a plasma diffraction grating excited in said semiconductor propagation medium by current injection through electrodes having a period Λ;

a modulator for generating said plasma grating in said semiconductor propagation medium and for varying Λ so as to direct said primary beam; and wherein said semiconductor propagation medium is provided with a plurality of upper electrodes 1 through n and a lower electrode which is grounded, and wherein said upper electrodes are comprised of doped N type material and said lower electrode is comprised of doped P type material.

39. The millimeter wavelength scanning antenna of claim 38 wherein voltages are applied to selected upper electrodes thereby generating plasma zones between said upper and lower electrode sets so as to define a grating period Λ.

40. The millimeter wavelength scanning antenna according to claim 39 wherein different voltages are applied to different sets of electrodes so as to vary Λ.

41. A millimeter wavelength scanning antenna comprising:

a semiconductor propagation medium having an input aperture and an output aperture and a plurality of switching electrodes connected thereto for generating a plasma diffraction grating therein;

a substrate comprised of insulating material to which said semiconductor propagation medium is connected;

a rib waveguide that distributes power along the input aperture of said semiconductor propagation medium;

a millimeter wavelength source;

a millimeter wavelength mixer connected to said millimeter wavelength source;

a circulator connected to said millimeter wavelength mixer and said millimeter wavelength source;

a clock connected to said millimeter wavelength mixer and said millimeter wavelength source;

a scan controller connected to said plurality of switching electrodes and programmed to generate signals that apply appropriate currents and voltages to said switching electrodes so as to effect a change in said plasma diffraction grating;

an intermediate frequency and low frequency processor connected to said scan controller.

42. A millimeter wavelength scanning antenna that operates based on diffraction of a primary beam by a modulated plasma grating, said antenna comprising:

a semiconductor propagation medium;

a photo induced plasma diffraction grating in said semiconductor propagation medium having a period $\Lambda$; and an illumination system comprising light from a semiconductor laser bar and a photo mask, said photomask for introducing said plasma diffraction grating.

43. The millimeter wavelength scanning antenna according to claim 42 wherein said photo mask comprises a liquid crystal spatial light modulator.

44. The millimeter wavelength scanning antenna according to claim 42 wherein said illumination system comprises a plurality of fiber optics.

45. The millimeter wavelength scanning antenna according to claim 44 wherein said plurality of fiber optics comprises a fiber set that is spatially arranged approximately perpendicularly to an upper facet of said semiconductor propagation medium.

46. A millimeter wavelength scanning antenna that operates based on diffraction of a primary beam by a modulated plasma grating, said antenna comprising:

a semiconductor propagation medium;

a photo injected plasma grating having a period $\Lambda$;

a plurality of optical fibers for illuminating said semiconductor propagation medium to generate said photo injected plasma grating; and wherein the period $\Lambda$ is varied by selectively controlling which of said plurality of optical fibers is illuminated.

47. The millimeter wavelength scanning antenna according to claim 46 wherein said plurality of optical fibers are configured in a vertical arrangement so as to provide for vertical scanning of the antenna.

48. The millimeter wavelength scanning antenna according to claim 47 wherein said semiconductor propagation medium comprises a plurality of semiconductor slabs so as to form a stacked vertical array, thereby permitting 2-D scanning.

* * * * *